US012173718B2

(12) United States Patent
Hwang et al.

(10) Patent No.: US 12,173,718 B2
(45) Date of Patent: Dec. 24, 2024

(54) FAN MOTOR

(71) Applicant: LG Electronics Inc., Seoul (KR)

(72) Inventors: Eunji Hwang, Seoul (KR); Byungjik Kim, Seoul (KR); Sunggi Kim, Seoul (KR); Jisu Hwang, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 18/356,549

(22) Filed: Jul. 21, 2023

(65) Prior Publication Data

US 2024/0093689 A1 Mar. 21, 2024

(30) Foreign Application Priority Data

Sep. 15, 2022 (KR) ..... 10-2022-0116537

(51) Int. Cl.

| | |
|---|---|
| ***F04D 25/06*** | (2006.01) |
| ***F04D 17/16*** | (2006.01) |
| ***F04D 25/08*** | (2006.01) |
| ***F04D 29/049*** | (2006.01) |
| ***F04D 29/58*** | (2006.01) |

(52) U.S. Cl.

CPC ..... *F04D 25/0606* (2013.01); *F04D 17/165* (2013.01); *F04D 25/082* (2013.01); *F04D 29/049* (2013.01); *F04D 29/584* (2013.01)

(58) Field of Classification Search

CPC ..... F04D 17/165; F04D 25/0606; F04D 25/082; F04D 29/584

See application file for complete search history.

(56) References Cited

U.S. PATENT DOCUMENTS

| | | | | |
|---|---|---|---|---|
| 2,698,128 | A * | 12/1954 | Ault | F04D 29/526 417/353 |
| 3,709,570 | A | 1/1973 | Galbato | |
| 9,897,104 | B2 | 2/2018 | King et al. | |
| 2011/0001282 | A1* | 1/2011 | Taniguchi | B23Q 1/522 269/55 |
| 2015/0198084 | A1* | 7/2015 | Daimer | F16C 27/066 415/62 |
| 2018/0076682 | A1* | 3/2018 | Hwang | H02K 5/207 |

(Continued)

FOREIGN PATENT DOCUMENTS

| | | |
|---|---|---|
| DE | 102005025261 | 12/2006 |
| JP | 2006-038222 | 2/2006 |

(Continued)

OTHER PUBLICATIONS

Extended European Search Report in European Appln. No. 23184085.1, mailed on Jan. 31, 2024, 7 pages.

(Continued)

*Primary Examiner* — Audrey B. Walter
(74) *Attorney, Agent, or Firm* — Fish & Richardson P.C.

(57) ABSTRACT

A fan motor includes a heat dissipation fin. The heat dissipation fin includes an outer ring part, an inner ring part disposed inside the outer ring part, and a connection part connecting the outer ring part and the inner ring part. The inner ring part is elastically deformed to be inclined in parallel to a rotational shaft which is inclined when axial alignment between bearings is not made. Accordingly, the heat dissipation fin can reduce a temperature of the bearing while enclosing the bearing, and improve concentricity (axial alignment) of the bearing.

19 Claims, 20 Drawing Sheets

(56) References Cited

U.S. PATENT DOCUMENTS

| | | | | |
|---|---|---|---|---|
| 2019/0365167 | A1* | 12/2019 | Jung | A47L 9/2889 |
| 2019/0376561 | A1* | 12/2019 | Quist | F28F 9/013 |
| 2022/0094237 | A1 | 3/2022 | Kisch et al. | |

FOREIGN PATENT DOCUMENTS

| | | |
|---|---|---|
| JP | 2016-111739 | 6/2016 |
| KR | 10-2018-0028731 | 3/2018 |
| KR | 10-2018-0028842 | 3/2018 |
| KR | 10-2020-0125536 | 11/2020 |
| KR | 10-2021-0142444 | 11/2021 |
| KR | 10-2021-0151021 | 12/2021 |
| WO | WO 2015/063882 | 5/2015 |

OTHER PUBLICATIONS

Office Action in Korean Appln. No. 10-2022-0116537, mailed on Apr. 16, 2024, 16 pages (with English translation).

* cited by examiner

FAN MOTOR

CROSS-REFERENCE TO RELATED APPLICATION

Pursuant to 35 U.S.C. § 119(a), this application claims the benefit of the earlier filing date and the right of priority to Korean Patent Application No. 10-2022-0116537, filed on Sep. 15, 2022, the contents of which are incorporated by reference herein in their entirety.

TECHNICAL FIELD

The present disclosure relates to a fan motor, and more particularly, to a fan motor capable of improving bearing alignment.

BACKGROUND

Electric motors may be installed in home appliances such as a cleaner, a hair dryer, and the like.

A cleaner or a hair dryer may generate rotational force by using an electric motor as a power source.

For example, an electric motor may be fastened to a fan. The fan may generate airflow by being rotated as driving force is applied from the electric motor.

A handy stick cleaner or a hair dryer is operated while a user directly holds it by hand.

In order to enhance user portability and convenience, there is a need to reduce size and weight of a cleaner or a hair dryer.

In order to reduce a weight of a fan motor of a cleaner, it is preferable to use a plastic material, instead of a metal material, as a material for producing a housing.

However, in the case of the plastic material, a heat transfer coefficient (thermal conductivity) is lowered to 1/10 to 1/35 compared to an existing metal material. The housing that is made of the plastic material to surround a bearing hinders heat dissipation of the bearing.

As a result, in the bearing housing made of the plastic material, a temperature of the bearing is increased by 25° C. or more, compared to a bearing housing made of a metal material, thereby shortening the lifespan of the bearing and reducing reliability of the fan motor.

In order to solve the problems, a heat sink that has a shape exposed to the air while surrounding a bearing and is made of a material having high thermal conductivity is required.

When a plastic housing is injected, a heat sink made of a metal material may be inserted into the housing so that the housing and the heat sink can be integrally injected.

However, when the heat sink is manufactured by the insert-injection in the plastic housing, it is difficult to secure an alignment of the heat sink, which may cause misalignment between bearings on both sides during operation of the fan motor.

Therefore, a heat dissipation structure that has a self-aligning function capable of adjusting (aligning) concentricity between bearings while reducing a temperature of the bearings is required.

On the other hand, a plurality of bearings rotatably support a rotational shaft. Such bearings may have a double-side bearing support structure and a one-side bearing support structure depending on positions of the bearings disposed on a rotational shaft.

FIGS. 1A and 1B are conceptual views for explaining a problem caused in the case where a misalignment of concentricity (axial misalignment) between bearings on both sides occurs in the double-side bearing support structure.

FIG. 1A illustrates a case in which an axial alignment is made between a first bearing 2*a* and a second bearing 2*b* and concentricity between the both bearings is normal. FIG. 1B illustrates a case where the concentricity between the both bearings is abnormal due to axial misalignment between the first bearing 2*a* and the second bearing 2*b*.

In the double-side bearing support structure, the plurality of bearings 2*a* and 2*b* are mounted on both sides of a rotational shaft 1 with a rotor 3 (or permanent magnet) interposed therebetween. Since the double-side bearing support structure supports the rotor 3, which includes the permanent magnet having a relatively heavy weight, on both sides of the rotational shaft 1, it is advantageous in view of stably supporting the shaft.

However, when the concentricity alignment (axial alignment) between the bearings 2*a* and 2*b* is not offered, wear occurs due to friction between the rotational shaft 1 and the bearings 2*a* and 2*b*.

In the one-side bearing support structure, a plurality of bearings are mounted on one side (a single side) of the rotor 3 (or permanent magnet) or one side of the rotational shaft 1.

The one-side bearing support structure requires only one housing surrounding the bearings. This is more advantageous for miniaturization and weight reduction of the fan motor, and has no concern about misalignment between the bearings and the rotational shaft 1.

However, the one-side bearing support structure has a limitation in stably supporting the rotational shaft 1 because the plurality of bearings are located on the one side of the rotational shaft 1.

In related art, a disk-shaped heat sink has a larger diameter than an impeller to reduce temperatures of bearings, and a plurality of legs radially extending from one end of the heat sink.

The impeller and a rotor core are mounted on both ends of a rotational shaft. A plurality of bearings are disposed between the impeller and the rotor core to support the rotational shaft.

However, the related art discloses a one-side bearing support structure in which the plurality of bearings are disposed on one side of the rotor core having a relatively heavy weight, and there is a limit to stably supporting the rotational shaft.

In addition, the related art does not disclose a separate device for offering an axial alignment between the bearings.

In related art, an electric motor has a heat dissipation structure for bearings.

A can surrounds a bearing housing and acts as a heat dissipation fin (or heat sink).

Heat of a ball bearing which is generated during operation of the motor is dissipated to the outside of a casing cover sequentially through a ball bearing housing, a can, a motor casing, and the casing cover.

However, the related art discloses a one-side bearing support structure in which one bearing is disposed on one side of a rotor core and thus supports only one side of a rotational shaft. As a result, it is difficult to expect stable support of the rotational shaft.

In addition, the related art has a problem in that friction between the bearing and the rotational shaft occurs if the one side of the rotational shaft on which the single bearing is mounted and another side to which the rotor core is mounted are axially misaligned with each other.

SUMMARY

The present disclosure has been invented to provide a fan motor having a structure capable of solving the above problems.

A first aspect is to provide a fan motor having a heat dissipation fin that has a self-aligning function so as to improve axial alignment between bearings respectively supporting both sides of a rotational shaft.

A second aspect is to provide a fan motor having a heat dissipation fin that is capable of reducing temperatures of bearings by increasing an area exposed to air when a plastic housing is used to reduce a weight of the fan motor.

A third aspect is to provide a fan motor having a structure that is capable of increasing a support force for bearings by disposing a heat dissipation fin made of a metal material within a mold and enlarging a contact area between the heat dissipation fin and a plastic-injection surface when injecting plastic.

A fourth aspect is to provide a fan motor having a structure that is capable of significantly contributing to weight reduction of the motor by using a plastic housing.

A fifth aspect is to provide a fan motor having a structure that is capable of reducing an axial length of the fan motor as well as securing an insulation distance between a metal heat dissipation fin and a coil.

As a result of intensive research, the inventors of the present disclosure can achieve solution to the problems of the present disclosure and the aforementioned first to fifth aspects by the following embodiments of the present disclosure.

(1) In order to achieve the first aspect, a fan motor according to one embodiment of the present disclosure may include an impeller, a rotational shaft, a plurality of bearings, and at least one heat dissipation fin. The impeller may be mounted on the rotational shaft. The plurality of bearings may rotatably support a rotational shaft. The heat dissipation fin may enclose the bearing. The heat dissipation fin may include an outer ring part, an inner ring part, and a connection part. The outer ring part may extend in a cylindrical shape along an axial direction. The inner ring part may enclose the bearing. The inner ring part may be disposed inside the outer ring part to be radially spaced apart from an inner circumferential surface of the outer ring part. The connection part may extend between the outer ring part and the inner ring part. The connection part may connect the outer ring part and the inner ring part.

(2) In the item (1), the inner ring part may extend in a cylindrical shape along the axial direction. One end or each of both ends of the inner ring part may be a free end that is movable in a radial direction relative to one side of the inner ring part supported by the connection part. The inner ring part may be elastically deformed to be inclined in parallel to the rotational shaft, which is inclined when the plurality of bearings are not axially aligned with each other. According to this, the heat dissipation fin can tilt an angle of the bearing to match an inclination of the rotational shaft while enclosing the bearing, to perform a self-aligning function, which may result in improving the axial alignment between the bearings.

(3) In the item (1), the fan motor may further include a bearing housing surrounding and supporting the outer ring part, and the heat dissipation fin may be formed of a material different from a material of the bearing housing and is integrally coupled to an inner surface of the bearing housing.

(4) In order to achieve the second and fourth aspects, in the item (3), the bearing housing may be formed of a plastic material. The heat dissipation fin may be formed of a metal material. This can simultaneously achieve a weight reduction of the fan motor and a temperature reduction of the bearing.

(5) In the item (1), the inner ring part may be formed in a cylindrical shape, and concentrically disposed around the rotational shaft. The connection part may extend radially between an inner circumferential surface of the outer ring part and an outer circumferential surface of the inner ring part. According to this, the heat dissipation fin can have a simplified structure, and the inner ring part can be flexibly elastically supported by being connected to the outer ring part through the connection part.

(6) In the item (5), the connecting portion may connect a longitudinal center of the outer ring part and a longitudinal center of the inner ring part. With the configuration, the connection part between the outer ring part and the inner ring part can be located at a central portion of the heat dissipation fin in the axial direction. This can diversify a cross-sectional structure of the heat dissipation fin.

(7) In the item (5), the connection part may connect one end of the outer ring part and one end of the inner ring part. With the configuration, the connection part between the outer ring part and the inner ring part can be located on one axial end of the heat dissipation fin.

(8) In order to achieve the third aspect, in the item (1), the fan motor may further include a bearing housing surrounding the outer ring part. The heat dissipation fin may further include a plurality of heat dissipation expansion ribs each extending to protrude radially outward from the outer circumferential surface of the outer ring part, and coupled to the bearing housing. Through this, the heat dissipation expansion ribs can expand a heat dissipation area of the heat dissipation fin exposed to air, and also can improve support force for the bearing by being coupled to the bearing housing.

(9) In the item (1), the heat dissipation fin may further include a protrusion protruding radially inward from one end of the inner ring part. The protrusion may serve to fix a wave washer when the wave washer for applying a preload to the bearing is inserted into one side of the bearing.

(10) In the item (1), the fan motor may further include a rotor having a permanent magnet and mounted on the rotational shaft, and a plurality of bearing housings accommodating the plurality of bearings therein, respectively. The plurality of bearings may be mounted on both sides of the rotational shaft, respectively, with the rotor interposed therebetween, and may include a first bearing disposed adjacent to the impeller, and a second bearing disposed at an opposite side to the first bearing. The heat dissipation fin may include a first heat dissipation fin disposed between the first bearing and a first bearing housing accommodating the first bearing, and a second heat dissipation fin disposed between the second bearing and a second bearing housing accommodating the second bearing. Through this, the first bearing and the second bearing can stably support the both sides of the rotational shaft with the rotor interposed therebetween. In addition, since the plurality of heat dissipation fins enclose and elastically support the plurality of bearings on the both sides of the rotational shaft, respectively, the heat dissipation fins can more stably perform a self-aligning function.

(11) In the item (1), the fan motor may further include a rotor having a permanent magnet and mounted on the rotational shaft, and a plurality of bearing housings accommodating the plurality of bearings therein, respectively. The plurality of bearings may be mounted on both sides of the rotational shaft, respectively, with the rotor interposed therebetween, and may include a first bearing disposed adjacent to the impeller, and a second bearing disposed at an opposite side to the first bearing. The heat dissipation fin may be disposed between the second bearing and a second bearing housing accommodating the second bearing. Through this, the heat dissipation fin can enclose and elastically support the second bearing located on one side of the rotational shaft. This can result in achieving a self-aligning function while reducing the number of heat dissipation fins.

(12) In the item (10), the fan motor may further include a stopper disposed to face the impeller and extending radially inward from one end of the first bearing housing so as to cover the first bearing. With the configuration, the stopper can restrict the rotational shaft and the first bearing, which receive an axial load due to thrust generated when air is suctioned by the impeller, from being moved by the received axial load.

(13) In order to achieve the fifth aspect, in the item (1), the fan motor may further include a rotor having a permanent magnet and mounted on the rotational shaft, a stator having a coil and surrounding the rotor, and a plurality of bearing housings accommodating the plurality of bearings therein, respectively. The heat dissipation fin may be disposed between a second bearing disposed at a downstream side of the coil based on a flow direction of air, which is suctioned by the impeller, and a second bearing housing accommodating the second bearing. The fan motor may further include an insulation cover disposed between the coil and the heat dissipation fin to cover the heat dissipation fin. The insulation cover can secure an insulation distance between the heat dissipation fin and the coil made of a metal material, and can shorten a distance between the heat dissipation fin and the coil, thereby reducing an axial length of the fan motor.

(14) In the item (10), the fan motor may further include a shroud accommodating the impeller, a first housing accommodating the first bearing housing, and a second housing disposed at a downstream side of the first housing based on a flow direction of air suctioned by the impeller and accommodating the second bearing housing. The first housing may include a first coupling ring coupled to an inside of the shroud, and a plurality of first bridges extending radially between the first coupling ring and the first bearing housing. According to this, the first bridges can connect the first housing and the first bearing housing, so that the first bearing can be supported by the first housing.

(15) In the item (10), the fan motor may further include a shroud accommodating the impeller, a first housing coupled to an inside of the shroud, and a second housing coupled to a downstream side of the first housing based on a flow direction of air suctioned by the impeller. The second housing may include a second coupling ring coupled to the inside of the shroud, an accommodating portion extending axially from the second coupling ring, and a plurality of second bridges extending radially between the accommodating portion and the second bearing housing. According to this, the second bridges can connect the second housing and the second bearing housing, so that the second bearing can be supported by the second housing.

(16) In the item (1), the fan motor may further include a shroud accommodating the impeller, a plurality of vanes coupled to an inside of the shroud and guiding a flow of air suctioned by the impeller, a vane hub having the plurality of vanes on an outer circumferential surface thereof, and a plurality of bearing housings accommodating the plurality of bearings therein, respectively. A first bearing of the plurality of bearings may be disposed at a downstream side of the impeller based on a flow direction of the air, a first bearing housing of the plurality of bearing housings may accommodate the heat dissipation fin surrounding the first bearing, and the first bearing housing may be coupled to be accommodated inside the vane hub. According to this, the first bearing housing surrounding the heat dissipation fin can be coupled to be accommodated inside the vane hub, and the vane hub can stably support the first bearing housing and the heat dissipation fin.

(17) In the item (16), wherein a first recess is formed to be recessed in one side surface of the vane hub in the axial direction, wherein a vane cover is coupled to be accommodated in the first recess, wherein a second recess is formed to be recessed in one side surface of the vane cover in the axial direction, and wherein a portion of the impeller is accommodated in the second recess.

(18) A fan motor according to another embodiment of the present disclosure may include a rotational shaft on which an impeller is mounted, a plurality of bearings supporting the rotational shaft, and a heat dissipation fin enclosing at least one of the bearings. The heat dissipation fin may include an outer ring part, an inner ring part disposed inside the outer ring part and enclosing the bearing, and an elastic member disposed between the outer ring part and the inner ring part and elastically supporting the inner ring part so that the inner ring part is elastically deformed in parallel with an inclination of the rotational shaft when the plurality of bearings are not aligned with each other in an axial direction. According to this, the elastic member can replace the connection part of the heat dissipation fin, and can perform a self-aligning function of the heat dissipation fin.

(19) In the item (18), the elastic member may be formed in a cylindrical shape, and a cross-sectional shape cut along a longitudinal direction of the elastic member may be defined by a plurality of curved portions formed in an arcuate shape to come into contact with the outer ring part or the inner ring part in a circumferential direction, and a linear portion extending in the axial direction to connect the plurality of curved portions adjacent to each other in the axial direction. This can diversify an elastic support structure of the heat dissipation fin.

(20) In the item (18), the elastic member may be formed in a cylindrical shape, and a cross-sectional shape cut along a longitudinal direction of the elastic member may be defined by a curved portion convexly formed to come into contact with the outer ring part or the inner ring part in a circumferential direction, and a second curved portion connected to the first curved portion and convexly formed in an opposite direction to the first curved portion. Accordingly, a self-aligning structure of the heat dissipation fin can be implemented in various ways.

According to an embodiment of the present disclosure, the following effects can be provided.

First, a heat dissipation fin includes an inner ring part enclosing a bearing, an outer ring part surrounding the inner ring part, and a connection part connecting the outer ring part and the inner ring part. When a rotational shaft is obliquely disposed due to misalignment of concentricity of the bearing in a double-side bearing support structure, the inner ring part can be elastically deformed according to an inclination of the rotational shaft, thereby improving axial alignment of the bearing. In addition, an occurrence of wear due to friction between the bearing and the rotational shaft can be minimized.

Second, the heat dissipation fin includes heat dissipation expansion ribs that extend radially from an outer circumferential surface of the outer ring part. This can increase an area exposed to air even though using a casing and a housing that are made of a plastic material for reducing a weight of a fan motor of a cleaner, thereby lowering a temperature of the bearing.

Third, the heat dissipation fin is accommodated inside a second bearing housing, and the heat dissipation expansion ribs of the heat dissipation fin are coupled to second bridges extending from the second bearing housing to an inner circumferential surface of a second housing. When the heat dissipation pin is integrally manufactured with the bearing housing through insert-injection into a mold during plastic injection, support strength for the bearing can be increased.

Fourth, a shroud, a first housing, a second housing, a first bearing housing, and a second bearing housing, etc. that define the exterior of the fan motor can be made of a plastic material, which can significantly contribute to reducing a weight of the motor.

Fifth, an insulation cover is disposed between the coil of a stator and the heat dissipation fin made of a metal material, so as to secure an insulation distance between the coil and the heat dissipation fin and shorten an axial distance between the coil and the heat dissipation fin, thereby reducing an axial length of the fan motor.

DETAILED DESCRIPTION

Hereinafter, a fan motor according to an embodiment of the present disclosure will be described in detail with reference to the accompanying drawings.

In the following description, in order to clarify the characteristics of the present disclosure, descriptions of some components may be omitted.

1. Definition of Terms

It will be understood that although the terms first, second, etc. may be used herein to describe various elements, these elements should not be limited by these terms. These terms are generally only used to distinguish one element from another.

It will be understood that when an element is referred to as being "connected with" another element, the element can be connected with the another element or intervening elements may also be present. In contrast, when an element is referred to as being "directly connected with" another element, there are no intervening elements present.

A singular representation used herein may include a plural representation unless it represents a definitely different meaning from the context.

The term "fan motor" used in the following description may be understood as a concept meaning a device that suctions or blows air by rotating a fan using power of an electric motor or the like.

The term "radial" used in the following description means a shape extending like spokes from a central point in all directions.

The term "self-alignment" used in the following description means that an inclination of a surface surrounding a bearing is automatically adjusted according to an inclination of a shaft.

The term "thrust" used in the following description means a force applied by a fluid such as air to an impeller in a direction opposite to an axial direction when the impeller suctions the fluid in the axial direction, namely, a force acting on the impeller or a rotational shaft on which the impeller is mounted.

The term "axial direction" used in the following description means a longitudinal direction of the rotational shaft.

The term "radial direction" used in the following description means a longitudinal direction of a line segment from a center of a circle or cylinder to a point on a circumference.

The term "circumferential direction" used in the following description means a direction of a circumference of a circle.

The terms "upper side", "lower side", "right side", "left side", "front side" and "rear side" used in the following description will be understood through the coordinate system shown in FIG. 2.

The term "axial direction" used in the following description may be understood as a concept corresponding to a vertical or up-down direction.

The term "radial direction" used in the following description may be understood as a concept corresponding to a left-right direction or a forward-backward direction.

2. Description of Configuration of Fan Motor According to One Embodiment

Figure 1A:
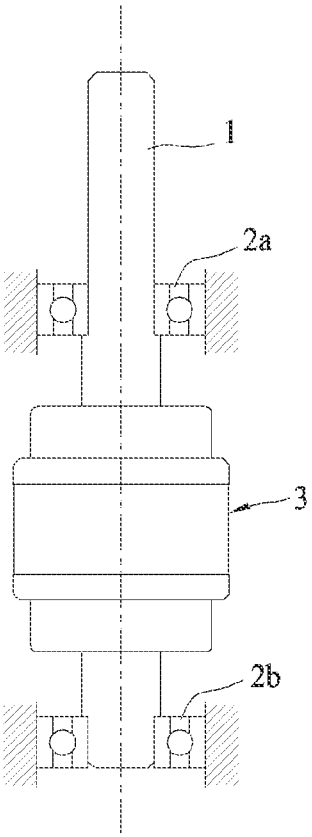
FIGS. 1A and 1B are conceptual views for explaining a problem caused in the case where a misalignment of concentricity (axial misalignment) between bearings on both sides occurs in a double-side bearing support structure.
Figure 1B:
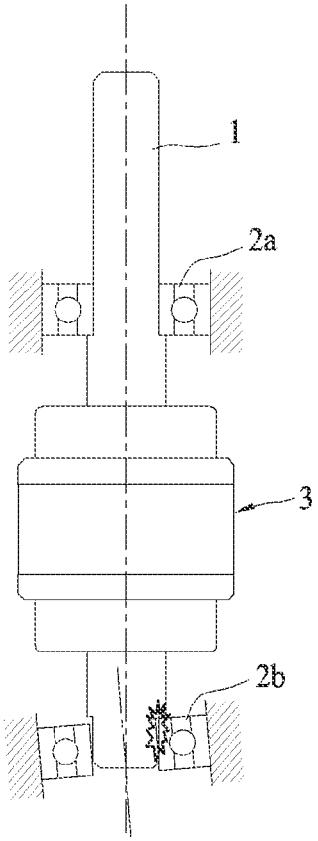
Figure 2:
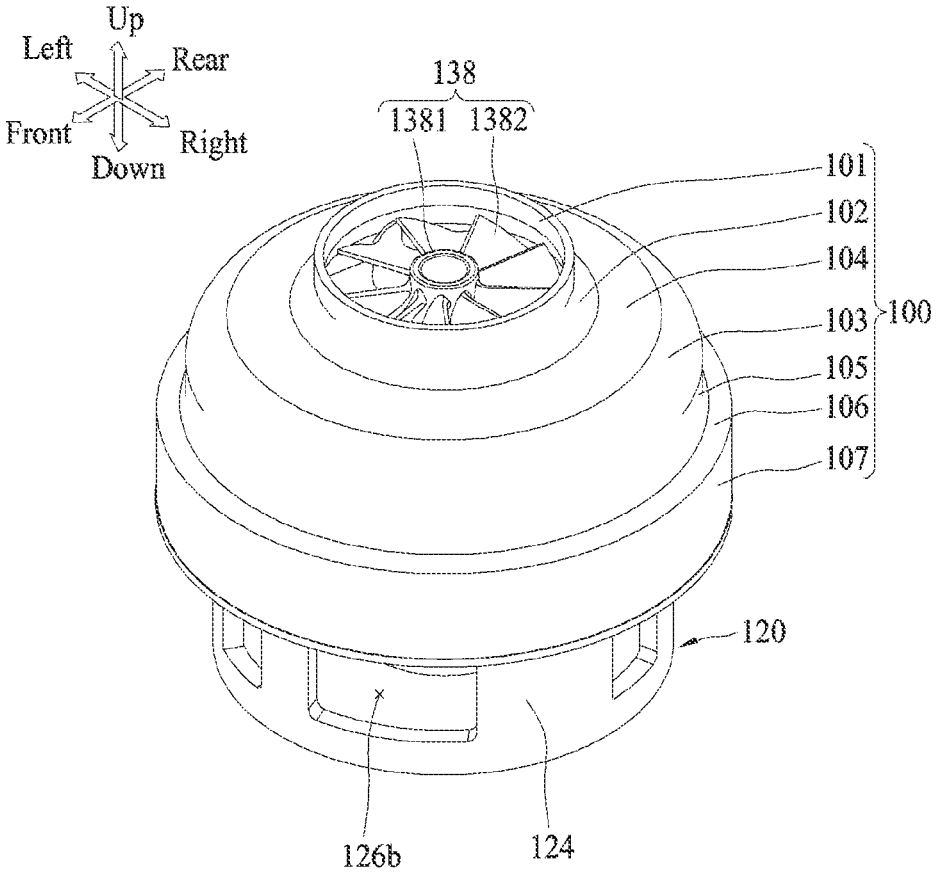
FIG. 2 is a perspective view illustrating appearance of a fan motor in accordance with the present disclosure.

FIG. 2 is a perspective view illustrating appearance of a fan motor in accordance with the present disclosure.

Figure 3:
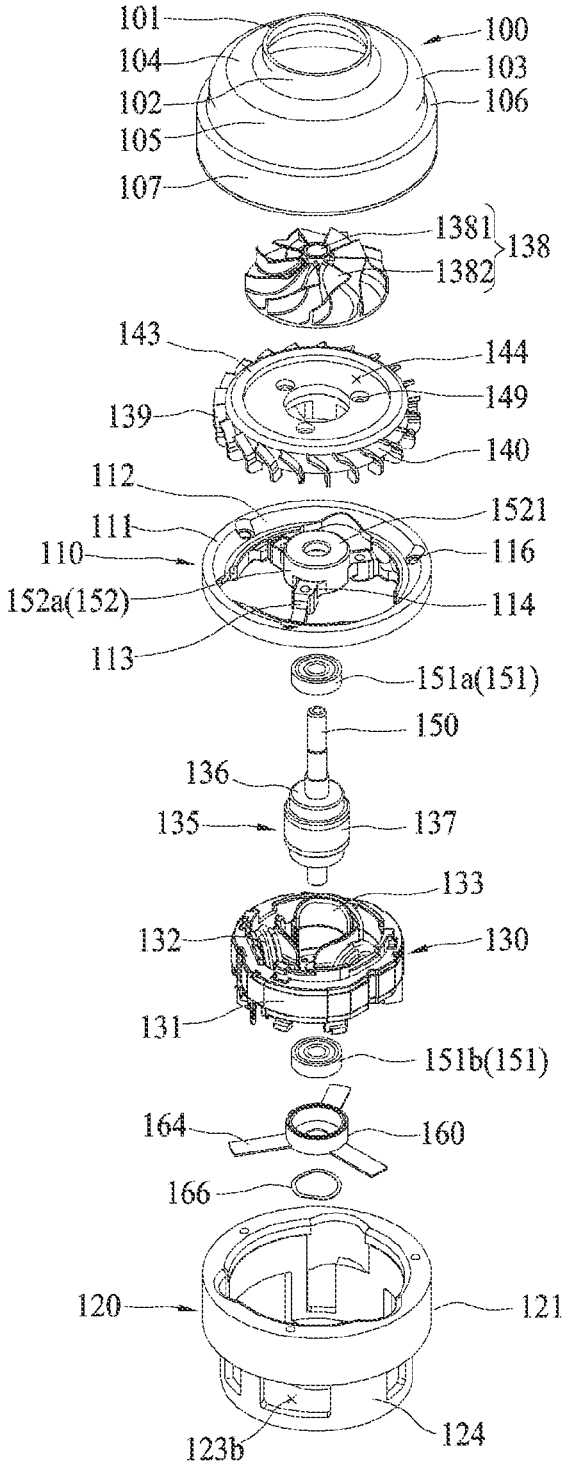
FIG. 3 is an exploded view of the fan motor of FIG. 2.

FIG. 3 is an exploded view of the fan motor of FIG. 2.

Figure 4:
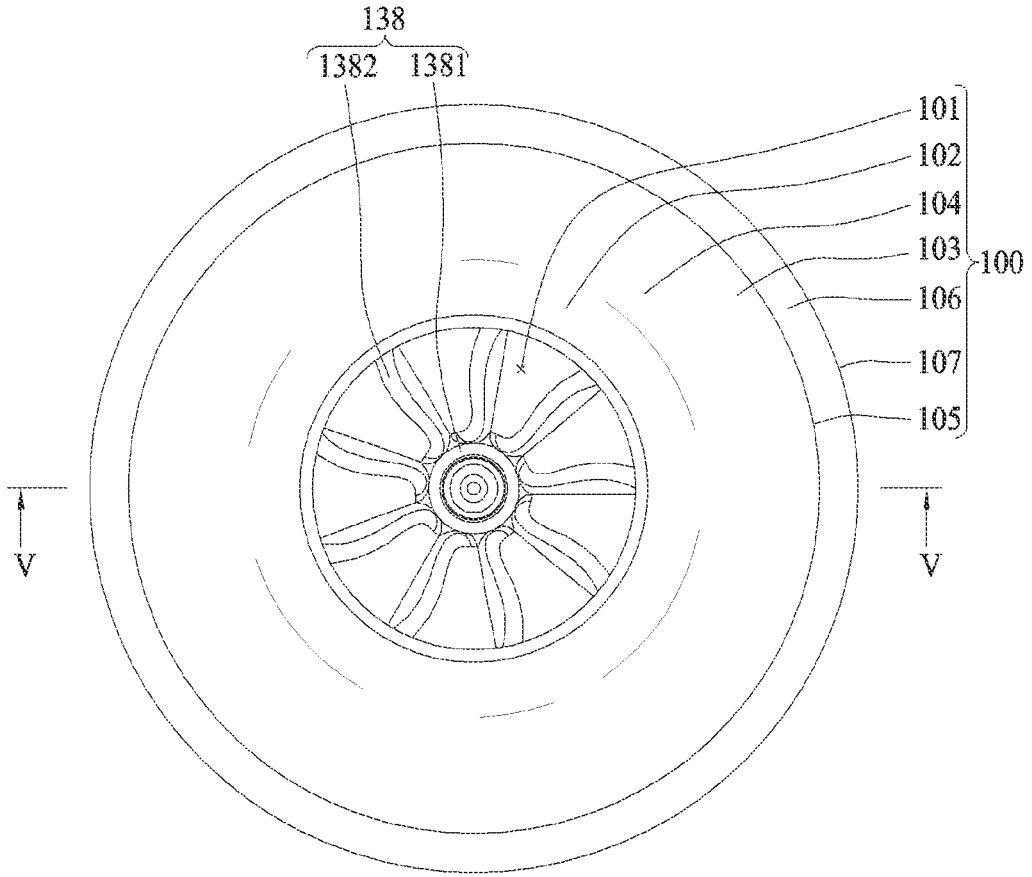
FIG. 4 is a planar view illustrating the fan motor of FIG. 2, viewed from a top.

FIG. 4 is a planar view illustrating the fan motor of FIG. 2, viewed from a top.

Figure 5:
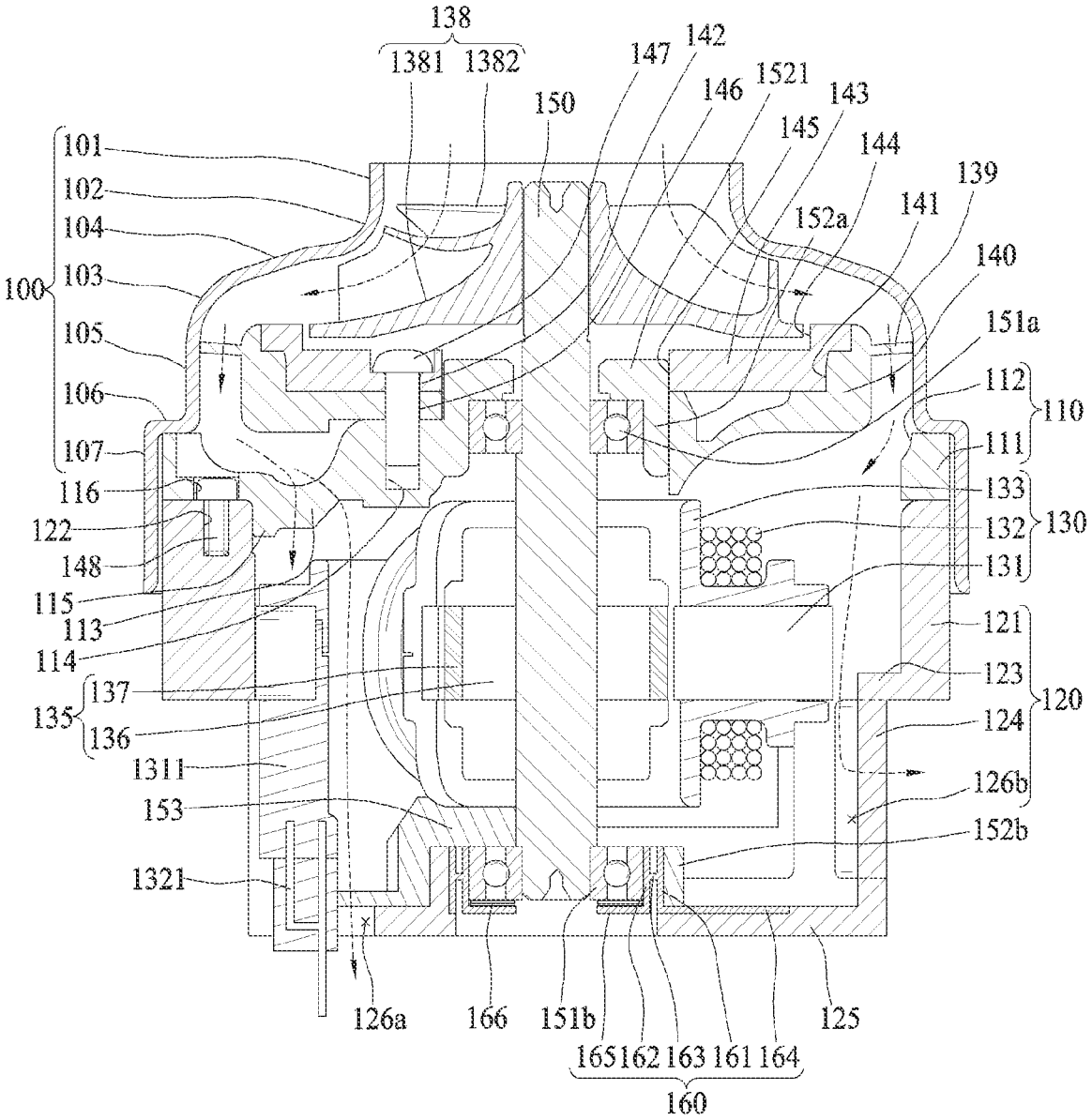
FIG. 5 is a sectional view illustrating a section of the fan motor, taken along a line V-V in FIG. 4.

FIG. 5 is a sectional view illustrating a section of the fan motor, taken along a line V-V in FIG. 4.

Figure 6:
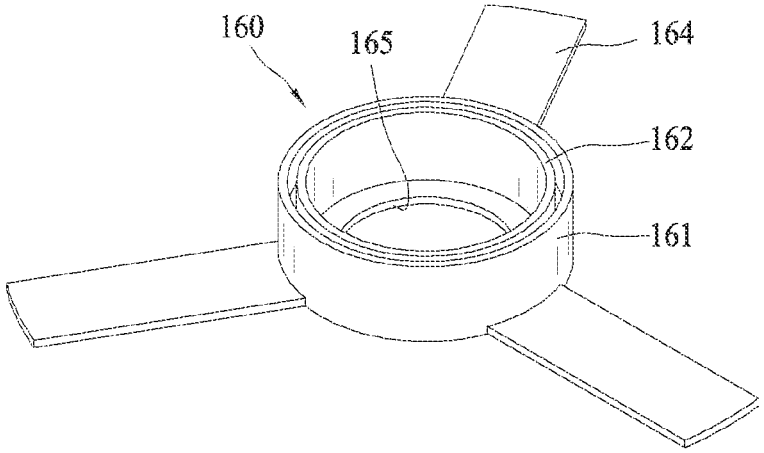
FIG. 6 is a perspective view illustrating a structure of a heat dissipation fin in FIG. 5.

FIG. 6 is a perspective view illustrating a structure of a heat dissipation fin 160 in FIG. 5.

Figure 7:
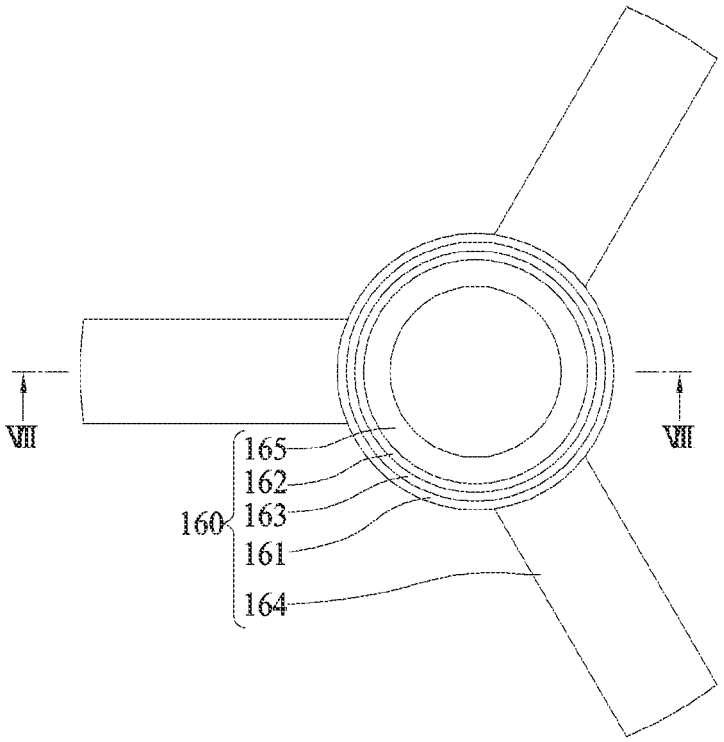
FIG. 7 is a planar view illustrating the heat dissipation fin of FIG. 6, viewed from a top.

FIG. 7 is a planar view illustrating the heat dissipation fin 160 of FIG. 6, viewed from a top.

Figure 8:
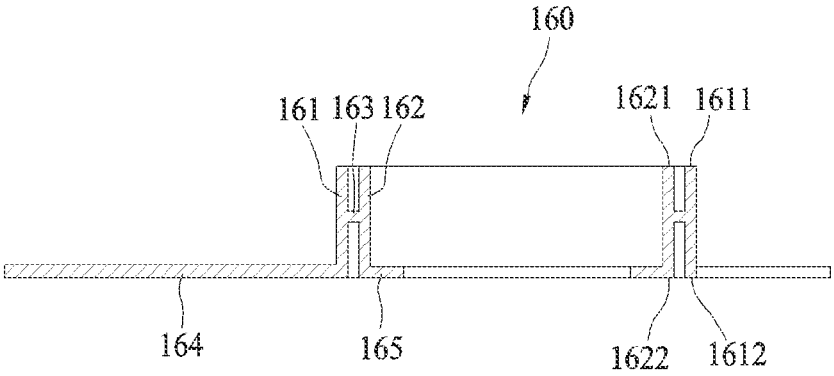
FIG. 8 is a sectional view illustrating a section of the heat dissipation fin, taken along a line VIII-VIII in FIG. 7.

FIG. 8 is a sectional view illustrating a section of the heat dissipation fin 160, taken along a line VIII-VIII in FIG. 7.

The fan motor of the present disclosure can be applied to home appliances such as a handy-stick cleaner and the like.

The fan motor may roughly include a casing, an impeller 138, and a motor unit.

The casing defines appearance of the fan motor. The casing includes a shroud 100, a first housing 110, and a second housing 120. The casing may be formed of a plastic material.

The shroud 100 has an accommodation space in which the impeller 138 and vanes 139 are accommodated. The shroud 100 defines a boundary isolating outside and inside of the fan motor. Movement paths of air generated by the impeller 138 may be formed between the shroud 100 and the impeller 138 and between the shroud 100 and a vane hub 140 to be described later.

The shroud 100 is formed in a cylindrical shape. However, the shroud 100 may vary in diameter along a longitudinal direction of the cylinder.

Explaining a detailed configuration of the shroud 100, the shroud 100 may include an inlet port 101, curved portions 102 and 103, an inclined portion 104, a linear portion 105, a radial extension portion 106, and a coupling portion 107. The detailed configuration of the shroud 100 may be divided in an order from an upstream side to a downstream side of the shroud 100 based on an air flow direction.

The inlet port 101 is located at an end portion of the upstream side of the shroud 100. The inlet port 101 is formed in a cylindrical shape. The inlet port 101 has relatively small diameter and short length compared to other components of the shroud 100. The inlet port 101 may be formed through the shroud 100 in an axial direction. One end portion of the impeller 138 may be accommodated inside the inlet port 101.

Accordingly, air generated by the impeller 138 is suctioned through the inlet port 101.

The inclined portion 104 is disposed at a downstream side of the inlet port 101. The inclined portion 104 is inclined with respect to a rotational shaft 150 so that its diameter gradually increases from the upstream side to the downstream side of the shroud 100.

The curved portions 102 and 103 may include a first curved portion 102 and a second curved portion 103. The first curved portion 102 is formed in a curved shape having a preset first curvature to connect the inlet port 101 and the inclined portion 104. The second curved portion 103 is formed in a curved shape having a preset second curvature to connect the inclined portion 104 and the linear portion 105.

The first curved portion 102 and the second curved portion 103 may be curved in opposite directions to each other. The first curvature and the second curvature may be different from each other.

The linear portion 105 has a larger diameter than the inclined portion 104. The linear portion 105 is formed in a cylindrical shape. A plurality of vanes 139 to be described later may be coupled to be in contact with an inner circumferential surface of the linear portion 105.

The radial extension portion 106 extends in a radial direction between the linear portion 105 and the coupling portion 107.

The rotational shaft 150 is disposed in a center of the casing. The rotational shaft 150 extends along the axial direction passing through the center of the casing.

One end portion of the rotational shaft 150 is accommodated inside the shroud 100. The impeller 138 is rotatably mounted on the one end portion of the rotational shaft 150.

The impeller 138 includes a hub 1381 and a plurality of blades 1382.

The hub 1381 is inclined so that its diameter increases along the axial direction. The diameter of the hub 1381 gradually increases from an upstream-side end portion to a downstream-side end portion of the hub 1381 based on an air flow direction.

A shaft through-hole is formed through the hub 1381 in the axial direction such that the one end portion of the rotational shaft 150 is inserted through a central portion of the hub 1381.

Each of the plurality of blades 1382 may spirally extend along the axial direction of the hub 1381. One end portion of the blade 1382 may protrude radially from one axial end of the hub 1381. Another end portion of the blade 1382 may protrude from another axial end of the hub 1381 in the axial direction.

The plurality of blades 1382 are spaced apart from one another at preset intervals along a circumferential direction of the hub 1381.

With the configuration, the impeller 138 can rotate together with the rotational shaft 150. As the plurality of blades 1382 rotate at high speed together with the hub 1381, air moves in an inner space of the shroud 100 and thereby external air can be suctioned.

The vanes 139 are disposed on an outer circumferential surface of the vane hub 140.

The vane hub 140 may be formed in a cylindrical shape. The vane hub 140 may have a diameter which is larger than a maximum diameter of the hub 1381. A length of the vane hub 140 may be shorter than the diameter of the vane hub 140.

The vane 139 may be provided in plurality. The plurality of vanes 139 are disposed on an outer circumferential surface of the vane hub 140 to be spaced apart from one another in the circumferential direction. The plurality of vanes 139 protrude radially outward from the outer circumferential surface of the vane hub 140. The plurality of vanes 139 may be inclined into a curved shape with a preset curvature.

A bending (inclination) direction of the vane 139 may be opposite to a bending (inclination) direction of the blade 1382. For example, based on the air flow direction, the blades 1382 may be inclined in a clockwise direction while the vanes 139 may be inclined in a counterclockwise direction.

The vanes 139 are configured to switch the air flow direction from the radial direction to the axial direction. Accordingly, air generated by the impeller 138 can be guided by the vanes 139 to flow in the axial direction.

A bearing through-hole may be formed through a central portion of the vane hub 140 so that a first bearing housing 152*a*, which will be described later, is inserted therethrough. The central portion of the vane hub 140 surrounds the first bearing housing 152*a* inserted through the bearing through-hole.

A first recess 141 may be formed to be recessed in one surface of the vane hub 140 in the axial direction. The first recess 141 is formed to surround a rim and a lower surface of the vane cover 143.

The vane cover 143 may be inserted into the first recess 141 to cover an upper surface of the vane hub 140. A height of the rim of the vane cover 143 may correspond to a recessed depth of the vane hub 140 in the axial direction.

Accordingly, an upper surface of the rim of the vane cover 143 can be flush with the upper surface of the vane hub 140, thereby minimizing flow resistance of air when the air suctioned through the inlet port 101 flows from the impeller 138 to the vanes 139.

A second recess 144 may be formed to be recessed in one surface of the vane cover 143 in the axial direction. An outer end portion of the hub 1381 is accommodated in the second recess 144. The second recess 144 is formed to surround a rim and a lower surface of the hub 1381 at preset intervals in the axial and radial directions.

An upper surface of the outer lower end portion of the hub 1381 can be flush with the upper surface of the rim of the vane cover 143 based on a bottom surface of the second recess 144, thereby minimizing flow resistance of air when the air suctioned through the inlet port 101 flows from the impeller 138 to the vanes 139.

A stopper accommodating hole 145 may be formed in the central portion of the vane cover 143 such that a stopper 1521 to be described later is inserted therein. The central portion of the vane cover 143 surrounds the stopper 1521 inserted in the stopper accommodating hole 145.

A plurality of fastening holes 142 and 146 may be formed through the vane cover 143 and the vane hub 140 in an axial direction, respectively. The plurality of first fastening holes 142 formed through the vane cover 143 and the plurality of second fastening holes 146 formed through the vane cover 143 overlap each other in the axial direction. The plurality of first and second fastening holes 142 and 146 are spaced apart in the circumferential direction.

A first fastening member 147 such as a screw is fastened to the vane cover 143 and the vane hub 140 through the first fastening hole 142 and the second fastening hole 146. Accordingly, the vane cover 143 and the vane hub 140 can be fastened to each other.

Accommodation grooves 149 may be formed in a bottom surface of the vane cover 143 so that screw heads of the first fastening members 147 are accommodated therein.

An outer diameter of each of the plurality of vanes 139 that radially protrude from the outer circumferential surface of the vane hub 140 may correspond to an inner diameter of the linear portion 105 of the shroud 100. Accordingly, outer ends of the plurality of vanes 139 can be press-fitted to an inner circumferential surface of the linear portion 105 of the shroud 100.

In addition, the vane hub 140 may be fixed to the shroud 100 by the plurality of vanes 139, and coupled to the first bearing housing 152*a* to enclose the first bearing housing 152*a*, so as to support the first bearing housing 152*a*.

The rotational shaft 150 is disposed inside the shroud 100 to be rotatable relative to the shroud 100.

The bearing 151 is provided to rotatably support the rotational shaft 150. The bearing 151 may be provided in plurality.

The plurality of bearings 151 may include a first bearing 151*a* and a second bearing 151*b*.

The first bearing 151*a* and the second bearing 151*b* are spaced apart from each other on both sides of the rotational shaft 150 with a motor unit to be described later interposed therebetween.

A first bearing support portion is provided on one side of the rotational shaft 150. A second bearing support portion is provided on another side of the rotational shaft 150.

An impeller support portion is provided on one end portion of the rotational shaft 150. The first bearing support portion may have the same diameter as the impeller support portion.

A rotor support portion is provided on the rotational shaft 150. The rotor support portion may be formed to extend in the axial direction between the first bearing support portion and the second bearing support portion.

Diameters of the first bearing support portion and the second bearing support portion are smaller than that of the rotor support portion.

The first step jaw may be formed between the first bearing support portion and the rotor support portion, to restrict the first bearing 151*a* from moving toward the rotor 135 in the axial direction.

A second step jaw may be formed between the second bearing support portion and the rotor support portion, to restrict the second bearing 151*b* from moving toward the rotor 135 in the axial direction.

The following description of the bearing 151 may be applied to each of the first bearing 151*a* and the second bearing 151*b*, unless otherwise specified.

The bearing 151 may be implemented as a ball bearing 151. The ball bearing 151 is provided to support a radial load of the rotational shaft 150. The bearing 151 may include an outer ring, an inner ring, a plurality of balls, and a plurality of covers.

The outer ring is formed in a cylindrical shape. The bearing housing 152 may be formed to enclose the outer ring. The inner ring is formed in a cylindrical shape. The inner ring is disposed inside the outer ring to surround the bearing support portion.

The plurality of balls are disposed between the outer ring and the inner ring. The plurality of balls are spaced apart from one another at preset intervals in the circumferential direction of the outer ring and the inner ring.

The plurality of balls roll in contact with the outer ring and the inner ring between the outer ring and the inner ring. The inner ring rotates relative to the outer ring by the balls. The inner ring rotates together with the rotational shaft 150.

The plurality of covers are coupled to cover both sides of the outer ring and the inner ring in the axial direction, respectively.

With the configuration, the plurality of bearings 151 can stably and rotatably support both sides of the rotational shaft 150.

The bearing housing 152 is formed in a cylindrical shape. A bearing accommodating hole is formed through a central portion of the bearing housing 152 in the axial direction. The bearing 151 is accommodated in the bearing housing 152 through the bearing accommodating hole.

A first bearing housing 152*a* accommodates and encloses the first bearing 151*a*. A second bearing housing 152*b* accommodates and encloses the second bearing 151*b*.

The first housing 110 is fixedly inserted into the shroud 100.

The first housing 110 is disposed at a downstream side of the vane 139 based on the air flow direction.

The first housing 110 includes a first bearing housing 152*a*, a plurality of first bridges 113, and a first coupling ring 111.

The first bearing housing 152*a* is disposed inside the first coupling ring 111. The first coupling ring 111 is formed in a ring shape. An outer diameter of the first coupling ring 111 is formed to correspond to an inner diameter of a coupling portion 107 of the shroud 100.

The first coupling ring 111 may be press-fitted to an inner circumferential surface of the coupling portion 107 of the shroud 100. The first coupling ring 111 is fixed to an inner circumferential surface of the shroud 100.

An inner diameter of the first coupling ring 111 is larger than a diameter of the first bearing housing 152*a*. The first bearing housing 152*a* is disposed inside the first coupling ring 111.

The plurality of first bridges 113 extend radially between an inner circumferential surface of the first coupling ring 111 and an outer circumferential surface of the first bearing housing 152*a*. An outer end portion of each of the first bridges 113 is connected to the first coupling ring 111, and an inner end portion of the first bridge 113 is connected to the first bearing housing 152*a*.

A flow guide 112 is formed on the inner circumferential surface of the first coupling ring 111. The flow guide 112 is made to guide a flow direction of air that has passed through the vanes 139 to the inside of the motor unit.

The flow guide 112 is formed in a curved shape with a preset curvature.

The flow guide 112 protrudes radially from the inner circumferential surface of the first coupling ring 111.

One axial end of the flow guide 112 comes into contact with the radial extension portion 106. An inner diameter of the one axial end of the flow guide 112 may correspond to an inner diameter of the linear portion 105.

Another axial end of the flow guide 112 comes into contact with one axial end of the second housing 120 to be described later. An inner diameter of the another axial end of the flow guide 112 may correspond to an inner diameter of the one axial end of the second housing 120.

An inner diameter of the radial extension portion 106 may be larger than the inner diameter of the one axial end of the second housing 120, based on the inner circumferential surface of the coupling portion 107.

A radial protrusion length of the another axial end of the flow guide 112 may be larger than a radial protrusion length of the one axial end of the flow guide 112.

The inner circumferential surface of the flow guide 112 has an arcuate cross-section. The inner diameter of the flow guide 112 may gradually decrease from the one axial end to the another axial end of the flow guide 112.

The inner circumferential surface of the flow guide 112 connects the linear portion 105 to the one axial end of the second housing 120.

With the configuration, the flow guide 112 can minimize flow resistance of air that has passed through the vanes 139.

The first bridges 113 are disposed at the downstream side of the vane hub 140 based on the air flow direction. The first bridges 113 may be fastened to the vane hub 140.

A first fastening groove 114 is formed in an inner end portion of each of the first bridges 113. The first fastening groove 114 is disposed to overlap a first fastening hole 142 of the vane cover 143 and the second fastening hole 146 of the vane hub 140 in the axial direction. The first fastening member 147 such as a screw is fastened to the first fastening groove 114 through the first and second fastening holes 142 and 146.

Accordingly, the first bridge 113 and the vane hub 140 are coupled to each other.

As the impeller 138 rotates, external air is suctioned in a first axial direction from the inlet port 101 toward the coupling portion 107. At this time, the suctioned air applies a thrust that is as strong as a suction force of the impeller 138 to the impeller 138 and the rotational shaft 150 in a second axial direction opposite to the first axial direction.

The first bearing 151*a* may be moved in the second axial direction, which is opposite to an air suction direction, by the thrust applied to the rotational shaft 150.

To solve this problem, a stopper 1521 is disposed on one axial end of the first bearing housing 152*a*. The stopper 1521 extends radially from the one axial end of the first bearing housing 152*a* so as to cover the one axial end of the first bearing 151*a*.

A shaft through-hole is formed through a central portion of the stopper 1521 in the axial direction. The shaft through-hole has a diameter that is slightly larger than the diameter of the rotational shaft 150.

According to this, the stopper 1521 can restrict the first bearing 151*a* from moving in the second axial direction due to the thrust.

The thrust acting on the rotational shaft 150 is transferred to the first housing 110 through the first bearing 151*a*, the first bearing housing 152*a*, the first bridge 113, and the first coupling ring 111.

The first housing 110 may be referred to as a load-side housing in that it is located on one side of the rotational shaft 150 on which the thrust acts.

The second housing 120 may be referred to as an opposite load-side housing in that it is located on an opposite side of the load-side housing.

The second housing 120 may be inserted into the shroud 100.

The second housing 120 is disposed at a downstream side of the first housing 110 based on the air flow direction.

The second housing 120 includes a second coupling ring 121, an accommodating portion 124, a second bearing housing 152*b*, and a second bridge 125.

The second coupling ring 121 is formed in a circular ring shape. The second coupling ring 121 is disposed to face the first coupling ring 111.

An outer diameter of the second coupling ring 121 is formed to correspond to an inner diameter of the coupling portion 107 of the shroud 100. The second coupling ring 121 may be press-fitted to an inner circumferential surface of the coupling portion 107 of the shroud 100.

The first coupling ring 111 and the second coupling ring 121 may have different radial widths. For example, the radial width of the second coupling ring 121 may be larger than the radial width of the first coupling ring 111.

The radial width of the second coupling ring 121 may be larger than or equal to the radial width of the another axial end of the flow guide 112. The radial width of the second coupling ring 121 is formed to be constant along the axial direction.

An inner rim of the one axial end of the second coupling ring 121 is formed in a curved shape. This can minimize flow resistance of air that flows into the second coupling ring 121 from the flow guide 112.

The second coupling ring 121 defines an accommodation space therein to accommodate a stator core 131 of the motor unit, which will be described later.

A protrusion rib 115 protrudes from the another end of the first bridge 113 into the inner accommodation space of the second coupling ring 121. The protrusion rib 115 may protrude in a direction opposite to the first coupling ring 111. An outer circumferential surface of the protrusion rib 115 is formed to be in surface contact with an inner circumferential surface of the second coupling ring 121.

A coupling hole 116 is formed through an outer end portion of each of the first bridge 113 in the axial direction. A diameter of the coupling hole 116 is smaller than a circumferential width of the first bridge 113.

The coupling hole 116 is disposed between the first coupling ring 111 and the protrusion rib 115. The coupling hole 116 is provided in plurality disposed spaced apart from one another at equal intervals along the circumferential direction of the flow guide 112. This embodiment illustrates that the plurality of coupling holes 116 are spaced apart at 120-degree intervals.

With this configuration, the protrusion rib 115 can reinforce strength of the first bridge 113 that is reduced due to the coupling hole 116. In addition, the protrusion rib 115 may protrude to be fitted into the inner circumferential surface of the second coupling ring 121 so as to improve an assembling property between the first housing 110 and the second housing 120.

A plurality of second fastening grooves 122 may be formed in the one axial end of the second coupling ring 121. The second fastening groove 122 overlaps the coupling hole 116 in the axial direction.

The second fastening member 148, such as a screw, is fastened to the first bridge 113 and the second coupling ring 121 through the coupling hole 116 and the second fastening groove 122. Through this, the first housing 110 and the second housing 120 are fastened to each other by the second fastening member 148.

The second bearing housing 152*b* is formed in a cylindrical shape. An accommodation space is defined inside the second bearing housing 152*b* to accommodate the second bearing 151*b*. The second bearing housing 152*b* is formed in a penetrating manner in the axial direction. The second bearing housing 152*b* may surround the second bearing 151*b*.

The accommodating portion 124 is disposed at the downstream side of the second coupling ring 121. The accommodating portion 124 is made to accommodate a portion of the motor unit, for example, coils 132 of a stator 130 to be described later and the second bearing housing 152*b*.

The accommodating portion 124 is formed in a cylindrical shape. An inner diameter of the accommodating portion 124 is smaller than a diameter of the second coupling ring 121 and larger than a diameter of the second bearing housing 152*b*.

One axial end of the accommodating portion 124 may be connected to another axial end of the second coupling ring 121.

A radial reduction portion 123 extends in the radial direction between the another axial end of the second coupling ring 121 and the one axial end of the accommodating portion 124. The radial reduction portion 123 connects the another axial end of the second coupling ring 121 and the one axial end of the accommodating portion 124.

The second bearing housing 152*b* is disposed inside the accommodating portion 124. The second bearing housing 152*b* is disposed at a downstream side of the coils 132 of the stator 130 based on the air flow direction.

The second bridge 125 may extend radially between the accommodating portion 124 and the second bearing housing 152*b*. An outer end portion of the second bridge 125 may be connected to another axial end of the accommodating portion 124. An inner end portion of the second bridge 125 may be connected to an outer circumferential surface of the second bearing housing 152*b*.

An inner end portion of the second bridge 125 may be connected to the another axial end of the second bearing housing 152*b*. The second bridge 125 may be provided in plurality. The plurality of second bridges 125 may be spaced apart from one another in the circumferential direction of the second bearing housing 152*b*.

A plurality of first discharge holes 126*a* may be formed between the plurality of second bridges 125 adjacent to each other in the circumferential direction to allow air to flow to the outside. The plurality of first discharge holes 126*a* and the plurality of second bridges 125 each are alternately arranged in a spaced manner along the circumferential direction.

Accordingly, air passing through the accommodating portion 124 can be discharged in the axial direction through the plurality of first discharge holes 126*a*.

A plurality of second discharge holes 126*b* may be formed through a side surface of the accommodating portion 124 in the radial direction. The plurality of second discharge holes 126*b* may be spaced apart in the circumferential direction. According to this, air can be discharged radially from the inside of the accommodating portion 124.

The motor unit receives electrical energy to rotate the rotational shaft 150 and rotates the impeller 138 mounted on one end portion of the rotational shaft 150.

To this end, the motor unit includes a rotor 135 and a stator 130.

The rotor 135 includes a rotor core 136 and a permanent magnet 137.

The rotor core 136 may be formed by stacking thin electrical steel sheets in the axial direction. The rotor core 136 is formed in a cylindrical shape. A shaft through-hole is formed through a central portion of the rotor core 136. The shaft through-hole is formed through the rotor core 136 in the axial direction.

The rotor core 136 is mounted on the rotational shaft 150. A rotor support portion is provided on the rotational shaft 150. The rotational shaft 150 includes a first bearing support portion and a second bearing support portion. The rotor support portion is disposed between the first bearing support portion and the second bearing support portion. A diameter of the rotor support portion may be larger than diameters of the first bearing support portion and the second bearing support portion.

The rotor 135 may be disposed between the first bearing 151*a* and the second bearing 151*b*.

The permanent magnet 137 may be embedded inside the rotor core 136 or mounted on an outer circumferential surface of the rotor core 136. In this embodiment, the permanent magnet 137 is shown mounted on the outer circumferential surface of the rotor core 136.

The stator 130 includes a stator core 131 and coils 132.

The stator core 131 may be formed by stacking thin electrical steel sheets in the axial direction. The stator core 131 is formed in a cylindrical shape. A rotor through-hole is formed through a central portion of the stator core 131. The rotor through-hole is formed through the stator core 131 in the axial direction.

A diameter of the rotor through-hole is slightly larger than the diameter of the permanent magnet 137. The permanent magnet 137 may maintain a preset distance (air gap) from an inner circumferential surface of the stator core 131.

The stator core 131 includes a back yoke, a plurality of slots, and a plurality of teeth.

The back yoke is formed in a cylindrical shape.

The plurality of teeth are formed to protrude from the back yoke toward the rotational shaft 150 in the radial direction. Pole shoes may protrude in the circumferential direction from inner end portions of the plurality of teeth.

The plurality of slots are formed to penetrate through the stator core 131 in the axial direction. The plurality of teeth and the plurality of slots each are alternately arranged in a spaced manner in the circumferential direction of the stator core 131. This embodiment illustrates three teeth and three slots.

The plurality of teeth and the plurality of slots each may be spaced apart from one another at intervals of 120 degrees in the circumferential direction.

The plurality of coils 132 are wound on the stator core 131 through the plurality of slots, respectively. In this embodiment, three coils 132 are illustrated. Three-phase AC currents may be applied to the three coils 132.

The stator 130 is provided with a plurality of connectors 1311 so that external three-phase AC power is supplied to the coils 132. In this embodiment, three connectors 1311 are provided one by one for each phase.

The connectors 1311 are made to electrically connect an external three-phase AC power source and the coils 132. The connectors 1311 extend downward from the stator core 131 in the axial direction.

A plurality of lead wires 1321 protrude from a lower side of the connector 1311 in the axial direction to be exposed to the outside.

Connector accommodating holes are formed in the accommodating portion 124 to accommodate the connectors 1311, respectively.

Insulators 133 are provided for electrical insulation between the coils 132 and the stator core 131. The insulators 133 may be made of a non-conductor.

The insulators 133 may be disposed between the coils 132 and the stator core 131 to block current from flowing between the coils 132 and the stator core 131.

The plurality of coils 132 and the plurality of insulators 133 each may be spaced apart from one another at intervals of 120 degrees along the circumferential direction of the stator core 131.

The first bridges 113 are located at the upper side of the motor unit. The first bridges 113 and the coils 132 (or teeth) may be disposed so as not to overlap each other in the axial direction. The first bridges 113 do not hinder the flow of air guided by the flow guide 112 from the vanes 139.

The second bridges 125 are located at a lower side of the motor unit. The second bridges 125 and the coils 132 (or teeth) may be disposed to overlap each other in the axial direction.

The first bearing 151*a* and the second bearing 151*b* respectively supporting both sides of the rotational shaft 150 are supported by the first housing 110 and the second housing 120 which are different from each other.

Each of the first housing 110 and the second housing 120 is formed in a cylindrical shape. The first and second housings 110 and 120 have the same outermost diameter. The first and second housings 110 and 120 may be press-fitted to the inner circumferential surface of the coupling portion 107 of the single shroud 100 and may be fastened to each other in the axial direction.

However, the first housing 110 and the second housing 120 may not be aligned with each other in the axial direction due to various reasons such as molding or assembly tolerance.

Due to this, the first bearing 151*a* and the second bearing 151*b* supporting the single rotational shaft 150 are minutely misaligned with respect to the longitudinal direction of the shroud 100, which causes concentricity misalignment.

In addition, the rotational shaft 150 may be misaligned to be tilted with respect to the longitudinal direction of the shroud 100.

Therefore, in order to solve a problem of wear due to friction between the rotational shaft 150 and the bearing 151, which is caused by axial misalignment between the first and second bearings 151*a* and 151*b*, a heat dissipation fin 160 having a self-aligning function is provided.

The heat dissipation fin 160 is disposed between the bearing housing 152 and the bearing 151. The heat dissipation fin 160 may be applied to only one bearing 151 or to both bearings 151 in a double-side bearing support structure.

This embodiment illustrates an example in which the heat dissipation fin 160 is applied to only one of the both bearings 151. In particular, the heat dissipation fin 160 is shown disposed between the second bearing housing 152*b* and the second bearing 151*b* that are far apart from the impeller 138.

However, when the heat dissipation fins 160 are applied to the both bearings 151, the self-aligning function can be further improved.

The heat dissipation fin 160 includes an outer ring part 161, an inner ring part 162, and a connection part 163.

The outer ring part 161 and the inner ring part 162 may extend in the axial direction. The outer ring part 161 may be disposed to surround the inner ring part 162. The outer ring part 161 may be spaced apart from the inner ring part 162 while maintaining a constant distance.

The outer ring part 161 may be formed in a cylindrical shape. The outer ring part 161 may be disposed to face the second bearing housing 152*b* in the radial direction.

An outer diameter of the outer ring part 161 may correspond to an inner diameter of the second bearing housing 152*b*. The second bearing housing 152*b* may cover the outer ring part 161 in contact with the outer ring part 161.

The outer ring part 161 may be concentrically disposed together with the second bearing housing 152*b* with respect to the rotational shaft 150. An axial center line passing through a center of the outer ring part 161 in the axial direction and an axial center line passing through a center of the second bearing housing 152*b* in the axial direction may form the same straight line.

An outer circumferential surface of the outer ring part 161 may be in parallel to an inner circumferential surface of the second bearing housing 152*b*.

The inner ring part 162 is disposed inside the outer ring part 161. The inner ring part 162 may be formed in a cylindrical shape. The inner ring part 162 may be disposed to face the second bearing 151*b* in the radial direction.

An inner diameter of the inner ring part 162 may correspond to an outer diameter of the second bearing 151*b*. The inner ring part 162 may surround the second bearing 151*b* in contact with the second bearing 151*b*.

The inner ring part 162 may be concentrically disposed together with the second bearing 151*b* with respect to the rotational shaft 150. An axial center line passing through a center of the inner ring part 162 in the axial direction and an axial center line passing through a center of the second bearing 151*b* in the axial direction may form the same straight line.

An inner circumferential surface of the inner ring part 162 may be in parallel to an outer circumferential surface of the second bearing 151*b*.

The second bearing housing 152*b* and the second bearing 151*b* may be spaced apart from each other in the radial direction with the heat dissipation fin 160 interposed therebetween.

The connection part 163 is disposed between the outer ring part 161 and the inner ring part 162. The connection part 163 connects the outer ring part 161 and the inner ring part 162.

The connection part 163 extends from the inner circumferential surface of the outer ring part 161 to the outer circumferential surface of the inner ring part 162. The connection part 163 extends in the radial direction between the outer ring part 161 and the inner ring part 162. The connection part 163 may extend in the circumferential direction between the inner circumferential surface of the outer ring part 161 and the outer circumferential surface of the inner ring part 162.

The connection part 163 may be provided in one in the circumferential direction or provided in plurality to be spaced apart from each other in the circumferential direction. This embodiment illustrates an example of employing the single connection part continuously extending along the circumferential direction.

A radially outer end portion of the connection part 163 may be connected to the outer ring part 161, and a radially inner end portion of the connection part 163 may be connected to the inner ring part 162.

The outer ring part 161 and the inner ring part 162 may extend to have the same axial length. However, with no limit to this, the axial lengths of the outer ring part 161 and the inner ring part 162 may be different from each other.

The connection part 163 may be connected to axial central portions of the outer ring part 161 and the inner ring part 162.

The outer ring part 161 and the inner ring part 162 may be formed symmetrically in the axial direction, with respect to the connection part 163.

Both axial end portions 1621 and 1622 of the inner ring part 162 are free ends on the connection part 163.

Here, the free end means one axial end portion 1621 or another axial end portion 1622 of the inner ring part 162 that is freely movable in the radial direction relative to one side of the inner ring part 162 supported by the connection part 163.

One end portion 1611 of the outer ring part 161 and the one end portion 1621 of the inner ring part 162 are spaced apart from each other radially to be open in the second axial direction (the direction that thrust acts), and another end portion 1612 of the outer ring part 161 and the another end portion 1622 of the inner ring part 162 are spaced apart from each other radially to be open in the first axial direction (the direction that air is suctioned).

The connection part 163 may elastically support the both axial end portions 1611 and 1612 of the outer ring part 161 and the both axial end portions 1621 and 1622 of the inner ring part 162.

However, the outer ring part 161 may be supported in contact with the inner circumferential surface of the second bearing housing 152*b*.

Both of the axial end portions 1621 and 1622 of the inner ring part 162 may be elastically deformed by an external force around the connection part 163.

For example, the both axial end portions 1621 and 1622 of the inner ring part 162 may be elastically deformed according to an inclined arrangement of the rotational shaft 150. The inner ring part 162 may be elastically deformed in a direction parallel to an inclination direction of the rotational shaft 150 with respect to the outer ring part 161.

According to this configuration, even if the axial alignment between the first bearing 151*a* and the second bearing 151*b* is not made, the inner ring part 162 surrounding the second bearing 151*b* can be elastically deformed in the direction parallel to the inclination direction of the rotational shaft 150, which may result in minimizing an occurrence of wear due to friction between the rotational shaft 150 and the second bearing 151*b*.

The heat dissipation fin 160 further includes a protrusion 165.

The protrusion 165 protrudes radially from the another axial end portion of the inner ring part 162 toward the rotational shaft 150. The protrusion 165 may be formed in a circular ring shape. The protrusion 165 may extend along the circumferential direction of the inner ring part 162 while maintaining the same width.

An inner diameter of the protrusion 165 may be larger than or equal to the diameter of the rotational shaft 150.

A wave washer 166 may be disposed between the another axial end portion of the second bearing 151*b* and the protrusion 165. The wave washer 166 may be formed in a wavy ring shape. The wave washer 166 may be formed of a metal material having elasticity.

An outer diameter of the wave washer 166 may be smaller than or equal to that of the inner ring part 162. An inner diameter of the wave washer 166 may be larger than or equal to that of the rotational shaft 150. A diameter of the wave washer 166 may correspond to that of the second bearing 151*b*.

The wave washer 166 applies a preload to the inner ring of the bearing 151 in the axial direction, thereby minimizing radial or axial vibration of the balls of the ball bearing between the outer ring and the inner ring.

The protrusion 165 may prevent the wave washer 166 from being axially separated from the inside of the inner ring part 162.

The heat dissipation fin 160 may perform a heat dissipation function to dissipate heat, which is generated from the rotational shaft 150 and the bearing 151 during fast rotation of the fan motor, to the outside.

To this end, the heat dissipation fin 160 is formed of a metal material having a high heat transfer coefficient.

In addition, the heat dissipation fin 160 further includes a plurality of heat dissipation expansion ribs 164.

The heat dissipation expansion ribs 164 may be provided on the outer ring part 161. The heat dissipation extension rib 164 may extend radially outward from an outer circumferential portion of the outer ring part 161. The heat dissipation expansion ribs 164 are formed in a plate shape.

The heat dissipation expansion ribs 164 may be formed in a rectangular shape with a length longer than a width. The heat dissipation expansion ribs 164 may be formed to correspond to the second bridges 125. The second bridges 125 may be formed in a rectangular plate shape.

The heat dissipation expansion ribs 164 may be supported by the outer ring part 161. However, a lower surface of the heat dissipation expansion rib 164 may be stacked on an upper surface of the second bridge 125.

The plurality of heat dissipation expansion ribs 164 may be spaced apart from one another in the circumferential direction. The plurality of heat dissipation expansion ribs 164 may be arranged to overlap the coils 132 in the axial direction. The heat dissipation expansion ribs 164 may be spaced apart from the coils 132 at preset intervals in the axial direction. In this embodiment, three heat dissipation expansion ribs 164 are provided to be spaced apart at intervals of 120 degree in the circumferential direction.

According to this, the heat dissipation expansion ribs 164 can increase a contact area with air, such that heat transferred from the outer ring part 161 can be dissipated into air that is flowing inside the accommodating portion 124.

The heat dissipation expansion ribs 164 extend on the upper surfaces of the second bridges 125 and are connected to the second housing 120 through the second bridges 125, thereby increasing support strength of the heat dissipation fins 160.

In addition, the heat dissipation expansion ribs 164 are arranged to overlap the coils 132 so as not to interfere with the flow of air that is flowing axially in a space between the plurality of coils 132, thereby minimizing flow resistance of air that is discharged through the first discharge holes 126*a* between the plurality of second bridges 125.

The heat dissipation fins 160 are disposed at a downstream side of the coils 132 based on an air flow direction.

Since the heat dissipation fin 160 is a metal conductor, current flowing through the coil 132 may flow to the heat dissipation fin 160 if a distance between the coil 132 and the heat dissipation fin 160 is short. In order to prevent such current flowing through the coil 132 from leaking to the heat dissipation fin 160, an insulation distance must be secured between the coil 132 and the heat dissipation fin 160.

However, if an axial distance between the coil 132 and the second bearing 151*b* is increased to secure the insulation distance between the coil 132 and the heat dissipation fin 160, the rotational shaft 150 elongates and thereby an axial length of the fan motor increases, which causes a problem of enlarging the fan motor.

Therefore, it is necessary to shorten the axial length of the fan motor while securing the insulation distance between the coil 132 and the heat dissipation fin 160.

To this end, an insulation cover 153 may be provided between the coil 132 and the heat dissipation fin 160. The insulation cover 153 may be formed of a plastic material.

The insulation cover 153 is provided to cover one axial end of the heat dissipation fin 160. The insulation cover 153 may extend radially inward from one axial end of the second bearing housing 152*b* toward the rotational shaft 150.

An inner end portion of the insulation cover 153 may be spaced apart from the rotational shaft 150 at a preset distance (air gap).

The insulation cover 153 may be formed to cover one axial end and an outer circumferential surface of the second bearing housing 152*b*.

The insulation cover 153 may be provided in plurality. The plurality of insulation covers 153 may be spaced apart from one another at preset intervals in the circumferential direction of the second bearing housing 152*b*. The insulation covers 153 may be supported by being connected to the accommodating portion 124 of the second housing 120.

A distance between the coil 132 and the outer ring part 161 (or the inner ring part 162) is shorter than a distance between the coil 132 and the heat dissipation expansion rib 164.

The insulation cover 153 is disposed between the coil 132 and the outer ring part 161 (or the inner ring part 162). The insulation cover 153 covers the outer ring part 161 and the inner ring part 162.

According to this, the insulation cover 153 disposed between the coil 132 and the heat dissipation fin 160 can block current from flowing between the coil 132 and the heat dissipation fin 160.

Hereinafter, operations and effects of a fan motor according to one embodiment of the present disclosure will be described.

An operating state of the fan motor will first be described as follows.

When current is applied to the coil 132 of the stator 130 through the lead wire 1321, a magnetic field is generated around the coil 132. The coil 132 of the stator 130 and the permanent magnet 137 of the rotor 135 interact electromagnetically with each other, so that the rotor 135 rotates relative to the stator 130 centering on the rotational shaft 150. The rotational shaft 150 rotates together with the rotor 135 and transmits rotational force to the impeller 138. The impeller 138 is rotated by the rotational force transmitted through the rotational shaft 150.

The impeller 138 rotates air and suctions external air into the shroud 100 through the inlet port 101. The suctioned air passes through the vanes 139. The vanes 139 switch a rotational flow of the air to an axial flow.

The air which has been switched to the axial flow is guided by the flow guide 112 and moves toward the motor unit from the inside of the first coupling ring 111 of the first housing 110. The air comes into contact with the stator core 131 and the coil 132 of the motor unit, so as to cool heat generated from the coil 132.

After cooling the coil 132, the air passes through the motor unit and is discharged to the outside through the first discharge holes 126*a* between the second bridges 125 and the second discharge holes 126*b* formed through the side surface of the accommodating portion 124.

The plurality of bearings 151 rotatably support the rotational shaft 150.

The first bearing 151*a* and the second bearing 151*b* can stably support both sides of the rotational shaft 150 with the relatively heavy rotor 135 interposed therebetween.

In order to reduce a weight of a fan motor of a cleaner, a material of a casing and the like may change to a plastic material instead of a metal. Here, components whose material can be changed to the plastic material, may include not only the shroud 100 of the casing and the first and second housings 110 and 120, but also the impeller 138, the bearing housing 152, the stopper 1521, the insulation cover 153, and the like.

However, since the plastic material has a lower heat transfer coefficient than the metal material, a temperature of the bearing 151 or the like increases. This may shorten a lifespan of the bearing 151 and deteriorate reliability of the fan motor.

In order to solve these problems, the heat dissipation fin 160 that is made of a metal material having a shape exposed to air while enclosing the bearing 151 and having a high heat transfer coefficient is provided.

The heat dissipation fin 160 made of the metal material may be integrally molded with the bearing housing 152 by insert-injection when the bearing housing 152 is manufactured. During plastic injection for manufacturing the bearing housing 152, the heat dissipation fin 160 made of the metal material may be inserted into a mold and thereafter manufactured integrally with the bearing housing made of a different material.

However, when the heat dissipation fin 160 is manufactured by insert injection into the bearing housing 152 made of the plastic material, it is difficult to offer correct alignment of the heat dissipation fin 160. This may cause an alignment problem between the bearings 151 during the operation of the fan motor.

Therefore, the present disclosure provides the heat dissipation fin 160 having the shape that is capable of securing (aligning, maintaining) concentricity between the bearings 151 while reducing temperatures of the bearings 151.

Figure 9:
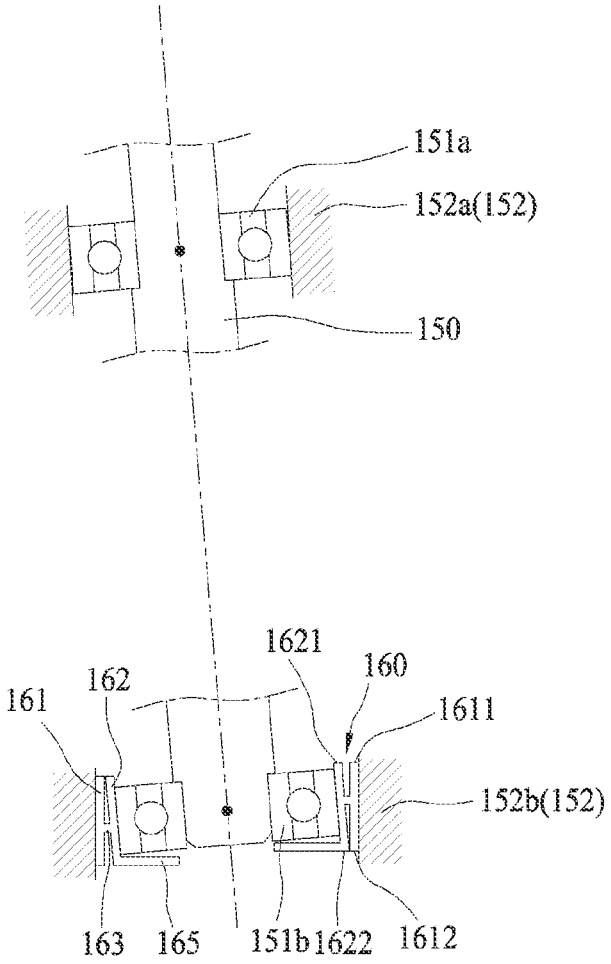
FIG. 9 is a conceptual view illustrating a self-aligning function of the heat dissipation fin in FIG. 8.

FIG. 9 is a conceptual view illustrating a self-aligning function of the heat dissipation fin 160 in FIG. 8.

The heat dissipation fin 160 of the present disclosure encloses the bearing 151. For example, the heat dissipation fin 160 may have a cross-section formed in an "H" shape or in a "n" or "U" shape. In this embodiment, the heat dissipation fin 160 has the cross-section in the "H" shape.

In order to maximize an area exposed to air, the outer ring part 161 and the inner ring part 162 of the heat dissipation fin 160 are spaced apart from each other in a direction perpendicular to the rotational shaft 150.

Through this, air can be introduced through an opening between the outer ring part 161 and the inner ring part 162, to be brought into contact with the inner circumferential surface of the outer ring part 161 and the outer circumferential surface of the inner ring part 162. This can enlarge a contact area between the air and the heat dissipation fin 160.

In addition, the inner circumferential surface of the inner ring part 162 may come into contact with the bearing 151 to transfer heat to the connection part 163 and the outer ring part 161.

The air can also be brought into contact with the connection part 163, by which the outer ring part 161 and the inner ring part 162 are connected to each other, so as to increase the contact area between the air and the heat dissipation fin 160. This can improve a heat dissipation performance of the heat dissipation fin 160.

The plurality of heat dissipation expansion ribs 164 may extend radially outward from the outer ring part 161 of the heat dissipation fin 160 and have a thin thickness and a large area, so that the contact area between the air and the heat dissipation fin 160 can be expanded.

The plurality of heat dissipation expansion ribs 164 may be arranged to overlap the coils 132 in the axial direction. According to this, the heat dissipation expansion ribs 164 can maximize an area, by which the heat dissipation fin 160 is exposed to the air, while minimizing flow resistance when the air passed through the coils 132 is discharged.

The first bearing 151*a* may be disposed adjacent to the impeller 138, and the hub 1381 of the impeller 138 may cover the first bearing 151*a*. Air suctioned by the impeller 138 does not flow to the first bearing 151*a* but moves toward the second bearing 151*b*.

The opening between the outer ring part 161 and the inner ring part 162 of the heat dissipation fin 160 can face a moving direction of the air suctioned by the impeller 138. Accordingly, heat generated from the bearing 151 can be efficiently dissipated. It is more effective in reducing a temperature of the bearing 151.

The first bearing 151*a* supported by the first bearing housing 152*a* and the second bearing 151*b* supported by the second bearing housing 152*b* may not be axially aligned with each other.

For example, when the second bearing 151*b* is disposed eccentrically to one side with respect to the first bearing 151*a*, the first bearing 151*a* and the second bearing 151*b* are arranged to be inclined with respect to a perpendicular line because the first bearing 151*a* and the second bearing 151*b* are connected by the rotational shaft 150.

The second bearing 151*b* is inclined with respect to the perpendicular line. One axial end of the second bearing 151*b* presses the one axial end 1621 of the inner ring part 162 of the heat dissipation fin 160 to the left toward the outer ring part 161. Another axial end of the second bearing 151*b* presses the another axial end portion 1622 of the inner ring part 162 of the heat dissipation fin 160 to the right toward the outer ring part 161.

The one axial end 1621 and the another axial end 1622 of the inner ring part 162 are elastically deformed along the inclination direction of the rotational shaft 150 based on the connection part 163. The outer ring part 161 may not be elastically deformed because of being supported by the second bearing housing 152*b*.

Therefore, according to the present disclosure, the casing and the bearing housing 152 are made of a plastic material to reduce the weight of the fan motor of the cleaner. The heat dissipation fin 160 that is made of a metal material having a high heat transfer coefficient is inserted into a mold to enclose the bearing 151 during plastic injection, and is integrally formed with the bearing housing 152 made of the plastic material through insert-injection.

The both axial end portions 1621 and 1622 of the inner ring part 162 of the heat dissipation fin 160 that encloses the bearing 151 are free ends that are bent in the radial direction around the connection part 163, and are elastically supported by the connection part 163.

With this configuration, even when the concentricity and the axial alignment are not obtained between the first bearing 151*a* and the second bearing 151*b* supporting the both ends of the rotational shaft 150, the inner ring part 162 of the heat dissipation fin 160 can be elastically deformed to be inclined in the direction in parallel to the rotational shaft 150 according to the inclination of the rotational shaft 150 while enclosing the bearing 151, thereby improving the axial alignment between the bearings 151.

3. Description of Configuration of Fan Motor According to Another Embodiment FIG. 10 is a sectional view illustrating a fan motor in accordance with another embodiment.

Figure 10:
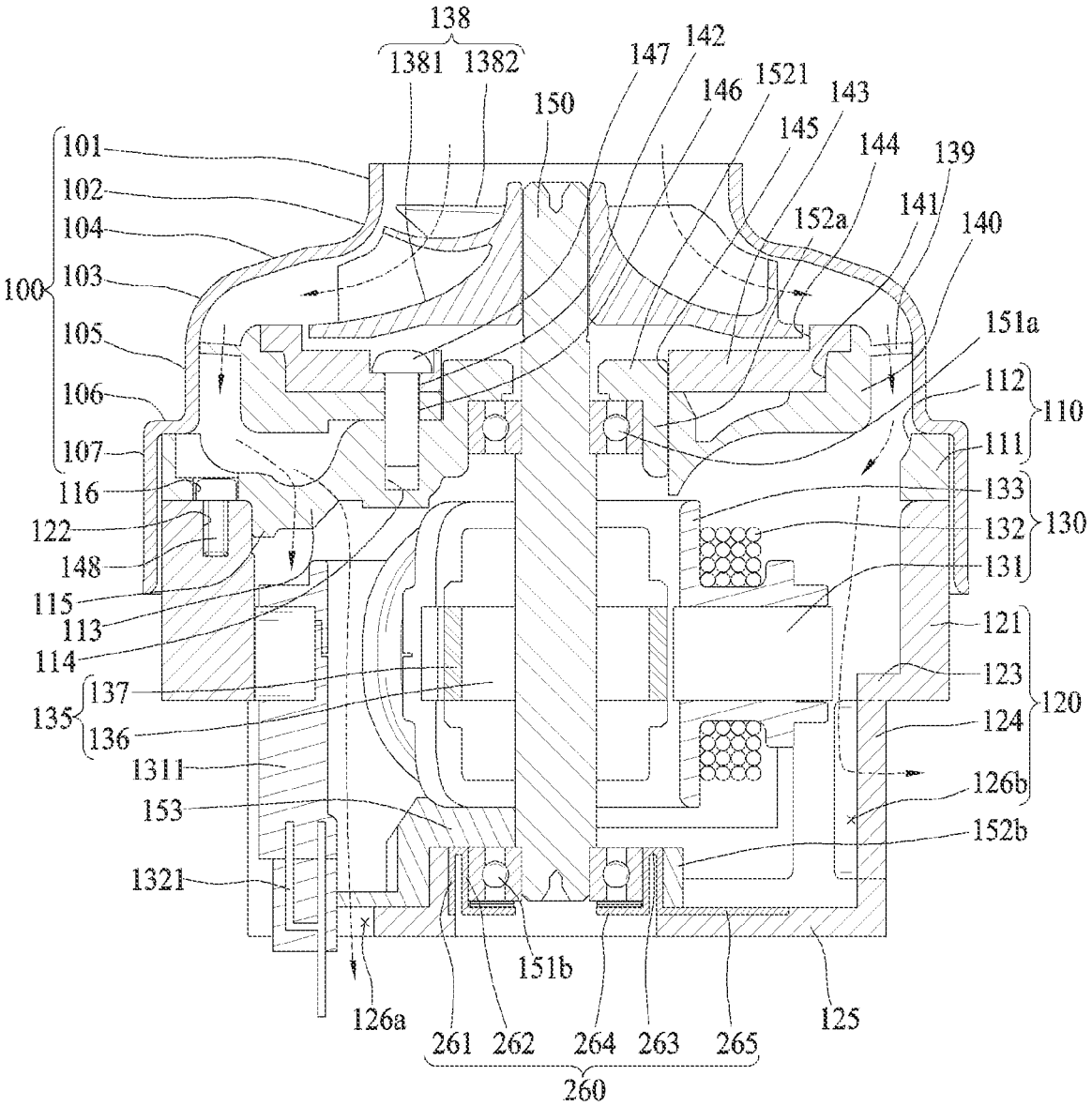
FIG. 10 is a sectional view illustrating a fan motor in accordance with another embodiment.
Figure 11:
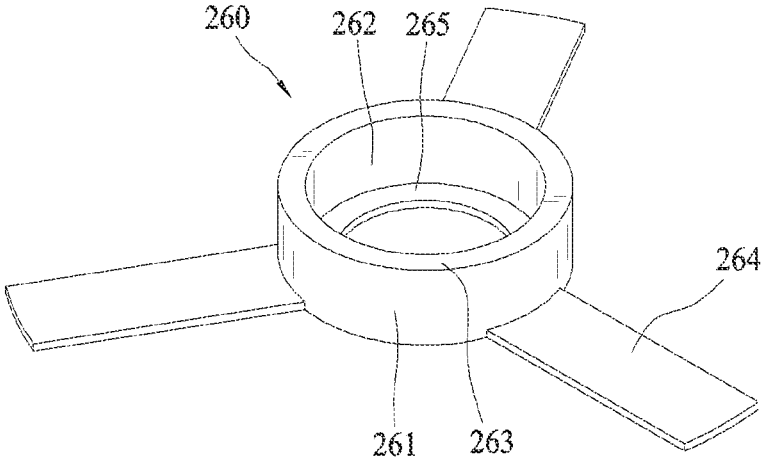
FIG. 11 is a perspective view illustrating a structure of a heat dissipation fin in FIG. 10.

FIG. 11 is a perspective view illustrating a structure of a heat dissipation fin 260 in FIG. 10.

Figure 12:
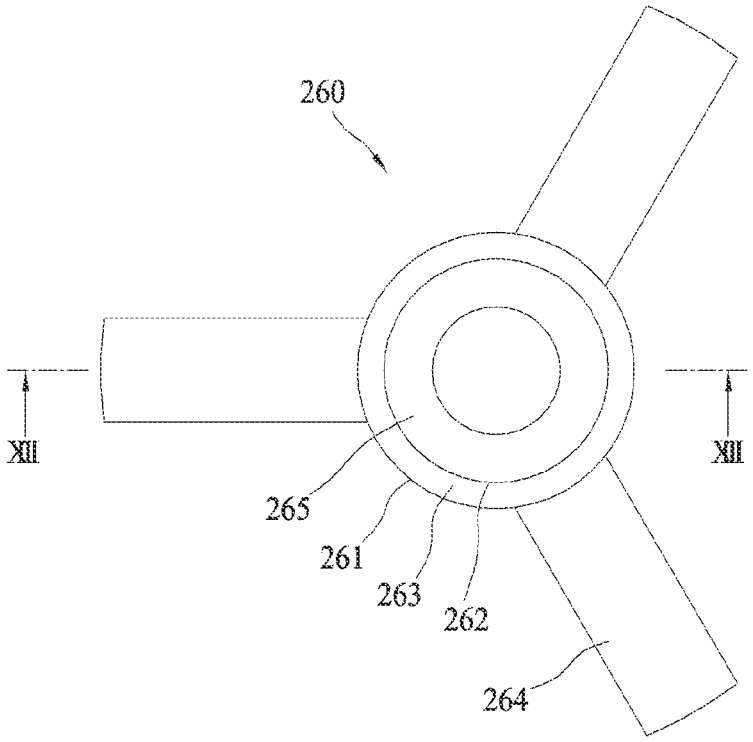
FIG. 12 is a planar view illustrating the heat dissipation fin of FIG. 11, viewed from a top.

FIG. 12 is a planar view illustrating the heat dissipation fin 260 of FIG. 11, viewed from a top.

Figure 13:
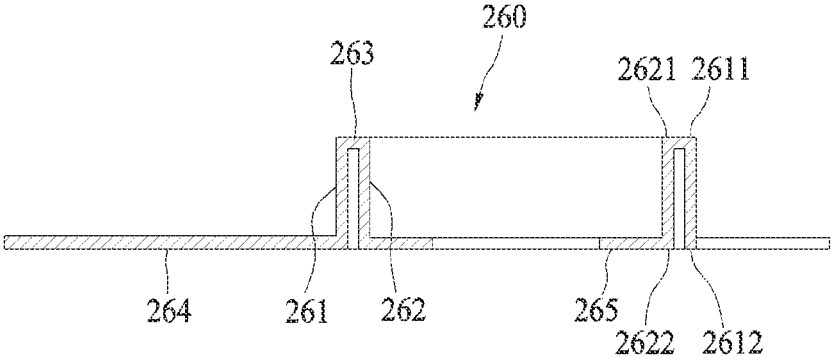
FIG. 13 is a sectional view illustrating the heat dissipation fin, taken along a line XIII-XIII in FIG. 12.

FIG. 13 is a sectional view illustrating the heat dissipation fin 260, taken along a line XIII-XIII in FIG. 12.

This embodiment is different from the embodiment of FIGS. 2 to 9 in view of a cross-sectional shape of the heat dissipation fin 260.

The heat dissipation fin 260 is formed to enclose the second bearing 151*b*. The heat dissipation fin 260 is disposed between the second bearing housing 152*b* and the second bearing 151*b*.

The heat dissipation fin 260 includes an outer ring part 261, an inner ring part 262, a connection part 263, a protrusion 265, and a plurality of heat dissipation expansion ribs 264.

The outer ring part 261 is formed in a cylindrical shape with a first diameter. The outer ring part 261 has a first hollow hole inside.

The inner ring part 262 is formed in a cylindrical shape with a second diameter. The first diameter is larger than the second diameter. The inner ring part 262 has a second hollow hole inside. A diameter of the first hollow hole is larger than that of the second hollow hole.

The outer ring part 261 is formed to surround the inner ring part 262. The inner ring part 262 is disposed inside the outer ring part 261. The outer ring part 261 and the inner ring part 262 are concentrically arranged to have the same center.

An outer circumferential surface of the outer ring part 261 may be coupled to be in surface-contact with the inner circumferential surface of the second bearing housing 152*b*.

An inner circumferential surface of the inner ring part 262 may be coupled to be in surface-contact with the outer circumferential surface of the second bearing 151*b*.

The outer ring part 261 and the inner ring part 262 may extend to have the same axial length.

The connection part 263 extends from one axial end 2611 of the outer ring part 261 to one axial end 2621 of the inner ring part 262. The connection part 263 may extend in the radial direction. The connection part 263 may be disposed at an upstream side of the outer ring part 261 and the inner ring part 262 based on an air flow direction.

The protrusion 265 protrudes from another axial end 2622 of the inner ring part 262 toward the rotational shaft 150. The protrusion 265 may extend radially inward. The protrusion 265 covers the another axial end of the second bearing 151*b*.

The protrusion 265 may be disposed at a downstream side of the inner ring part 262 based on the air flow direction. The protrusion 265 and the connection part 263 may be disposed on both ends of the inner ring part 262 at opposite sides to each other.

The one axial end 2621 of the inner ring part 262 may be supported by being connected to the connection part 263.

The another axial end 2622 of the inner ring part 262 is spaced apart from the outer ring part 261 in the radial direction and is a free end.

The another axial end 2622 of the inner ring part 262 and the protrusion 265 may be elastically deformed toward the outer ring part 261 based on the connection part 263 when an external force is applied in the radial direction.

The heat dissipation expansion rib 264 protrudes radially outward from the outer ring part 261 toward the another axial end of the accommodating portion 124 through the another axial end of the second bearing housing 152*b*. The plurality of heat dissipation expansion ribs 264 may be disposed on the outer ring part 261 to be spaced apart from one another at preset intervals along the circumferential direction.

In this embodiment, the heat dissipation expansion ribs 264 are spaced apart at intervals of 120 degrees in the circumferential direction. The heat dissipation extension ribs 264 may be formed up to the inner circumferential surface of the accommodating portion 124 or may extend up to the middle of the second bridges 125.

This embodiment illustrates an example in which the heat dissipation expansion ribs 264 extend up to the middle of the second bridges 125.

The second bearing housing 152*b* made of the plastic material and the heat dissipation fin 260 made of the metal material may be integrally formed with each other through insert-injection.

Therefore, according to this embodiment, the heat dissipation fin 260 can be formed of a metal material having a high heat transfer coefficient while enclosing the bearing 151, and the inclination of the bearing 151 can be automatically adjusted in the direction in parallel to the rotational shaft 150 when the axial alignment between the bearings 151 is not secured, thereby improving concentricity and alignment between the bearings 151.

Since other components are the same as or similar to those of FIGS. 2 to 9 described above, duplicate descriptions will be omitted.

4. Description of Configuration of Fan Motor According to Still Another Embodiment FIG. 14 is an exploded view illustrating components of a fan motor in accordance with still another embodiment of the present disclosure.

Figure 14:
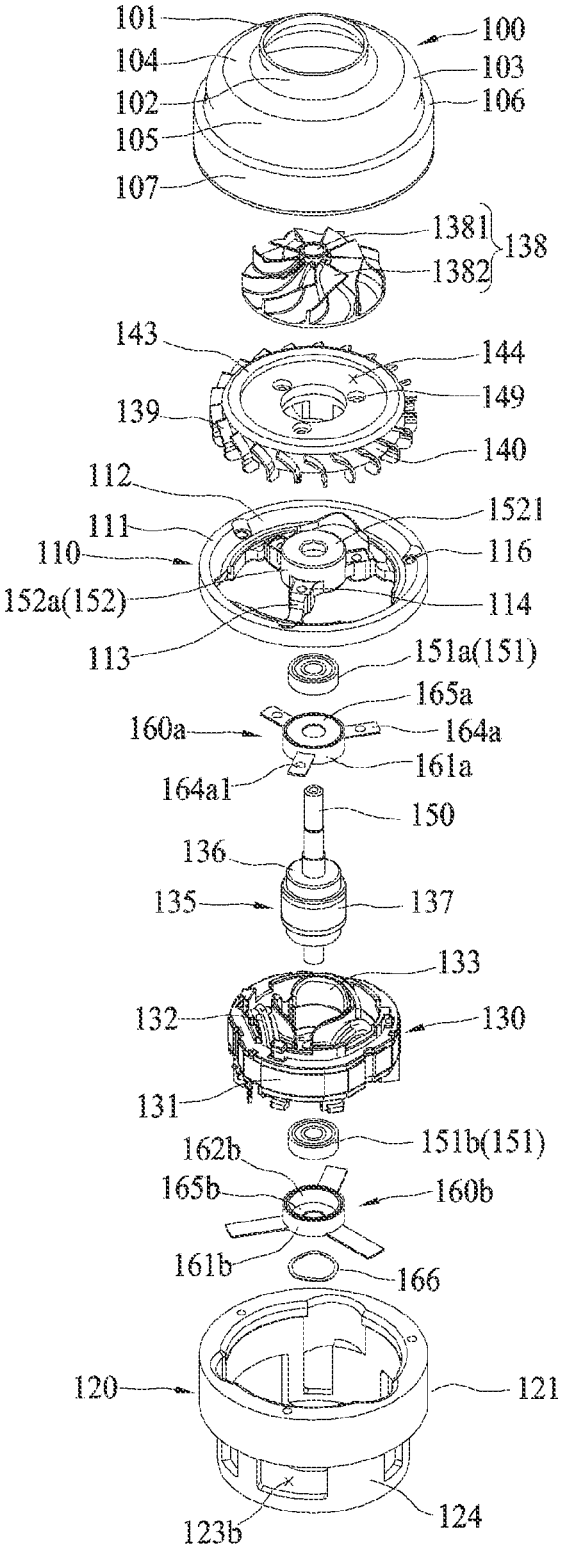
FIG. 14 is an exploded view illustrating components of a fan motor in accordance with still another embodiment of the present disclosure.
Figure 15:
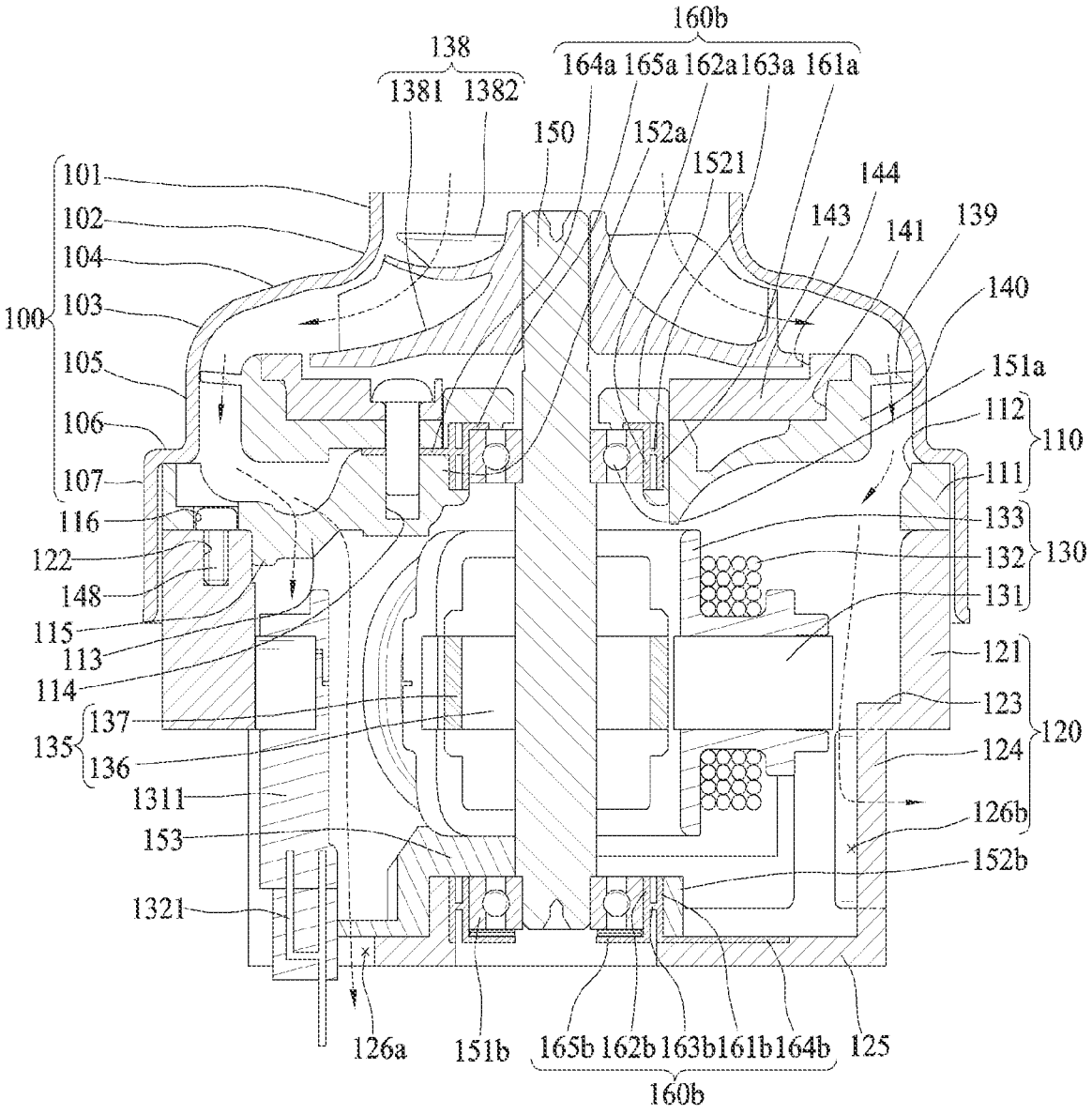
FIG. 15 is a sectional view illustrating a state in which the components of the fan motor of FIG. 14 are coupled.

FIG. 15 is a sectional view illustrating a state in which the components of the fan motor of FIG. 14 are coupled.

Figure 16:
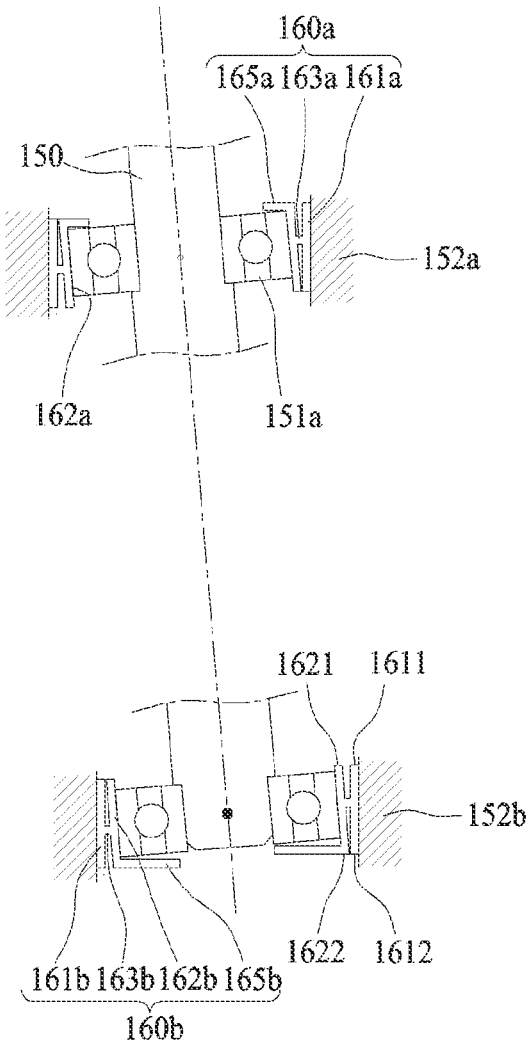
FIG. 16 is a conceptual view illustrating a self-aligning function of a heat dissipation fin in FIG. 15.

FIG. 16 is a conceptual view illustrating a self-aligning function of heat dissipation fins 160*a* and 160*b* in FIG. 15.

This embodiment is different from the previous embodiment of FIGS. 2 to 9 in that a plurality of heat dissipation fins 160*a* and 160*b* are provided to enclose the first bearing 151*a* and the second bearing 151*b*, respectively.

The plurality of heat dissipation fins 160*a* and 160*b* include a first heat dissipation fin 160*a* and a second heat dissipation fin 160*b*. The first heat dissipation fin 160*a* may be accommodated inside the first bearing housing 152*a* while enclosing the first bearing 151*a*.

This embodiment is the same as or similar to the previous embodiment of FIGS. 2 to 9 in that each of the first heat dissipation fin 160*a* and the second heat dissipation fin 160*b* includes an outer ring part 161*a*, 161*b*, an inner ring part 162*a*, 162*b*, a connection part 163*a*, 163*b*, a protrusion 165*a*, 165*b*, and heat dissipation expansion ribs 164*a*, 164*b*.

However, structure and arrangement direction of the first heat dissipation fin 160*a* is different from structure and arrangement direction of the second heat dissipation fin 160*b* in view of the following points.

The protrusion 165*a* of the first heat dissipation fin 160*a* protrudes radially inward from one axial end of the inner ring part 162*a*. Here, the one axial end of the inner ring part 162*a* means an upstream side of the inner ring part 162*a* based on an air flow direction.

The protrusion 165*a* of the first heat dissipation fin 160*a* faces a stopper 1521. The stopper 1521 covers the protrusion 165*a* and the first bearing 151*a*.

The inner ring part 162*a* of the first heat dissipation fin 160*a* may define an opening that is open toward a downstream side based on the air flow direction. The first bearing 151*a* is accommodated inside the inner ring part 162*a* through the opening.

The heat dissipation expansion ribs 164*a* of the first heat dissipation fin 160*a* are located between one axial end 1611 and another axial end 1612 of the outer ring part 161*a*. That is, the heat dissipation expansion ribs 164*a* of the first heat dissipation fin 160*a* may not be disposed on the one axial end 1611 or the another axial end 1612 of the outer ring part 161*a*, but may be disposed close to the connection part 163*a* in the axial direction.

The heat dissipation expansion ribs 164*a* are provided on an outer circumferential surface of the outer ring part 161*a*, and the connection part 163*a* is provided on an inner circumferential surface of the outer ring part 161*a*.

Rib mounting grooves for mounting the heat dissipation expansion ribs 164*a* are formed in the one axial ends of the first bridges 113. The heat dissipation expansion ribs 164*a* may be mounted in the rib mounting grooves to face the vane hub 140. The heat dissipation expansion ribs 164*a* may be disposed between the vane hub 140 and the first bridges 113.

The heat dissipation expansion rib 164*a* may be shorter than a radial length of the first bridge 113.

Third fastening holes 164*a*1 may be formed through the heat dissipation expansion ribs 164*a* in the axial direction, respectively. The third fastening hole 164*a*1 may be disposed to overlap the second fastening hole 146 of the vane hub 140 and the first fastening groove 114 of the first bridge 113 in the axial direction. The first fastening member 147 such as a screw can be fastened to the first fastening groove 114 of the first bridge 113 sequentially through the first fastening hole 142 of the vane cover 143, the second fastening hole 146 of the vane hub 140, and the third fastening hole 164*a*1 of the heat radiation expansion rib 164*a*.

The heat dissipation expansion ribs 164*a* are disposed between the vane hub 140 and the first bridges 113, respectively, and fastened to the vane hub 140 and the first bridges 113 by the first fastening members 147. This can further increase support strength of the heat dissipation fin 160*a*, 160*b*.

According to this embodiment, the first heat dissipation fin 160*a* is further provided to enclose the first bearing 151*a*. As the first and second heat dissipation fins 160*a* and 160*b* enclose the first bearing 151*a* and the second bearing 151*b* which support the both sides of the rotational shaft 150, concentricity and alignment between the both bearings 151 can be more stably improved. This can minimize an occurrence of wear due to friction between the rotational shaft 150 and the bearings 151 and also enhance reliability by virtue of the stable support for the bearings 151.

Since other components are the same as or similar to those in the previous embodiment of FIGS. 2 to 9, duplicated descriptions will be omitted.

5. Description of Configuration of Fan Motor According to Still Another Embodiment FIG. 17 is an exploded view illustrating components of a fan motor in accordance with still another embodiment of the present disclosure.

Figure 17:
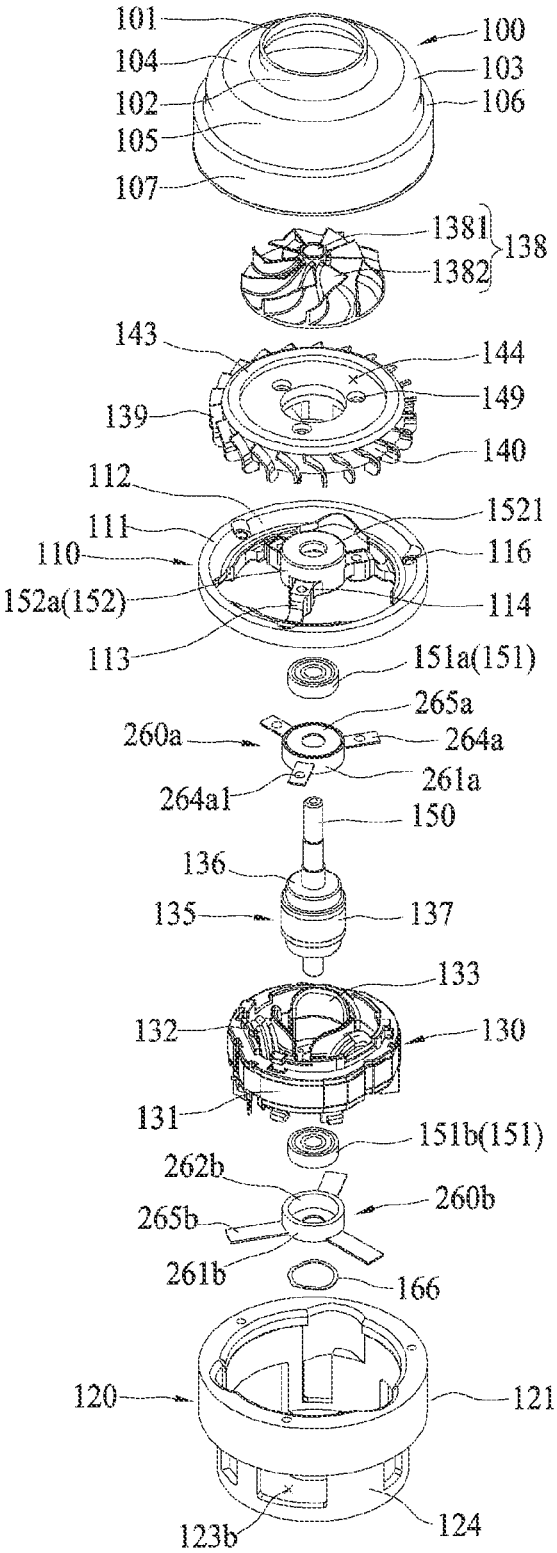
FIG. 17 is an exploded view illustrating components of a fan motor in accordance with still another embodiment of the present disclosure.
Figure 18:
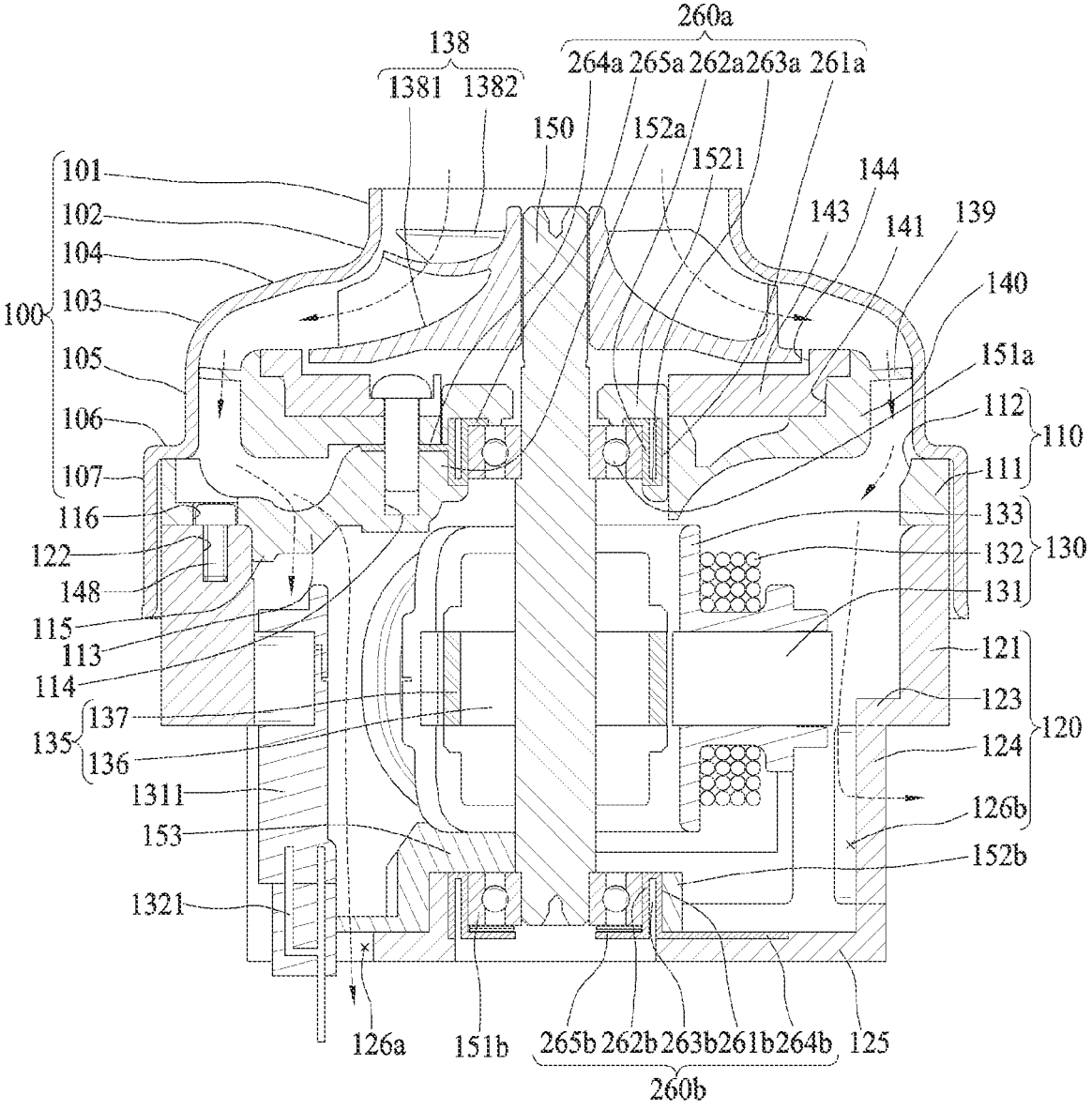
FIG. 18 is a sectional view illustrating a state in which the components of the fan motor of FIG. 17 are coupled.

FIG. 18 is a sectional view illustrating a state in which the components of the fan motor of FIG. 17 are coupled.

This embodiment is different from the previous embodiment of FIGS. 10 to 13 in that a plurality of heat dissipation fins 260*a* and 260*b* are provided to enclose the first bearing 151*a* and the second bearing 151*b*, respectively.

The plurality of heat dissipation fins 260*a* and 260*b* include a first heat dissipation fin 260*a* and a second heat dissipation fin 260*b*. The first heat dissipation fin 260*a* may be accommodated inside the first bearing housing 152*a* while enclosing the first bearing 151*a*.

This embodiment is the same as or similar to the previous embodiment of FIGS. 10 to 13 in that each of the first heat dissipation fin 260*a* and the second heat dissipation fin 260*b* includes an outer ring part 261*a*, 261*b*, an inner ring part 262*a*, 262*b*, a connection part 263*a*, 263*b*, a protrusion 265*a*, 265*b*, and heat dissipation expansion ribs 264*a*, 264*b*.

However, structure and arrangement direction of the first heat dissipation fin 260*a* is different from structure and arrangement direction of the second heat dissipation fin 260*b* in view of the following points.

The connection part 263*a* of the first heat dissipation fin 260*a* may extend in the radial direction between another axial end of the outer ring part 261*a* and another axial end of the inner ring part 262*a*. Here, the another axial ends of the outer ring part 261*a* and the inner ring part 262*a* mean a downstream side of the outer ring part 261*a* and the inner ring part 262*a* based on an air flow direction.

The protrusion 265*a* of the first heat dissipating fin 260*a* protrudes radially inward from one axial end of the inner ring part 262*a*. Here, the one axial end of the inner ring part 262*a* means an upstream side of the inner ring part 262*a* based on an air flow direction.

The protrusion 265*a* of the first heat dissipation fin 260*a* faces a stopper 1521. The stopper 1521 covers the protrusion 265*a* and the first bearing 151*a*.

The connection part 263*a* and the protrusion 265*a* of the first heat dissipation fin 260*a* may be disposed on opposite sides to each other in the axial direction with respect to the inner ring part 262*a*. The connection part 263*a* and the protrusion 265*a* of the first heat dissipation fin 260*a* may alternatively be disposed on opposite sides to each other in the radial direction with respect to the inner ring part 262*a*.

The inner ring part 262*a* of the first heat dissipation fin 260*a* may define an opening that is open toward a downstream side based on the air flow direction. The first bearing 151*a* is accommodated inside the inner ring part 262*a* through the opening.

The heat dissipation expansion ribs 264*a* of the first heat dissipation fin 260*a* are located between one axial end and another axial end of the outer ring part 261*a*. That is, the heat dissipation expansion ribs 264*a* of the first heat dissipation fin 260*a* may not be disposed on the one axial end or the another axial end of the outer ring part 261*a*, but may be disposed on the middle of the outer ring part 261*a* in the axial direction.

The heat dissipation expansion ribs 264*a* are provided on an outer circumferential surface of the outer ring part 261*a*, and the connection part 263*a* is provided on an inner circumferential surface of the outer ring part 261*a*.

Rib mounting grooves for mounting the heat dissipation expansion ribs 264*a* are formed in the one axial ends of the first bridges 113. The heat dissipation expansion ribs 264*a* may be mounted in the rib mounting grooves to face the vane hub 140. The heat dissipation expansion ribs 264*a* may be disposed between the vane hub 140 and the first bridges 113.

The heat dissipation expansion rib 264*a* may be shorter than a radial length of the first bridge 113.

Third fastening holes 264*a*1 may be formed through the heat dissipation expansion ribs 264*a* in the axial direction, respectively. The third fastening hole 264*a*1 may be disposed to overlap the second fastening hole 146 of the vane hub 140 and the first fastening groove 114 of the first bridge 113 in the axial direction. The first fastening member 147 such as a screw can be fastened to the first fastening groove 114 of the first bridge 113 sequentially through the first fastening hole 142 of the vane cover 143, the second fastening hole 146 of the vane hub 140, and the third fastening hole 264*a*1 of the heat radiation expansion rib 264*a*.

The heat dissipation expansion ribs 264*a* are disposed between the vane hub 140 and the first bridges 113, respectively, and fastened to the vane hub 140 and the first bridges 113 by the first fastening members 147. This can further increase support strength of the heat dissipation fin 260*a*, 260*b*.

According to this embodiment, the first heat dissipation fin 260*a* is further provided to enclose the first bearing 151*a*. As the first and second heat dissipation fins 260*a* and 260*b* enclose the first bearing 151*a* and the second bearing 151*b* which support the both sides of the rotational shaft 150, concentricity and alignment between the both bearings 151 can be more stably improved.

In addition, this can minimize an occurrence of wear due to friction between the rotational shaft 150 and the bearings 151 and also enhance reliability by virtue of the stable support for the bearings 151.

Since other components are the same as or similar to those in the previous embodiment of FIGS. 10 to 13, a duplicated descriptions will be omitted.

Figure 19:
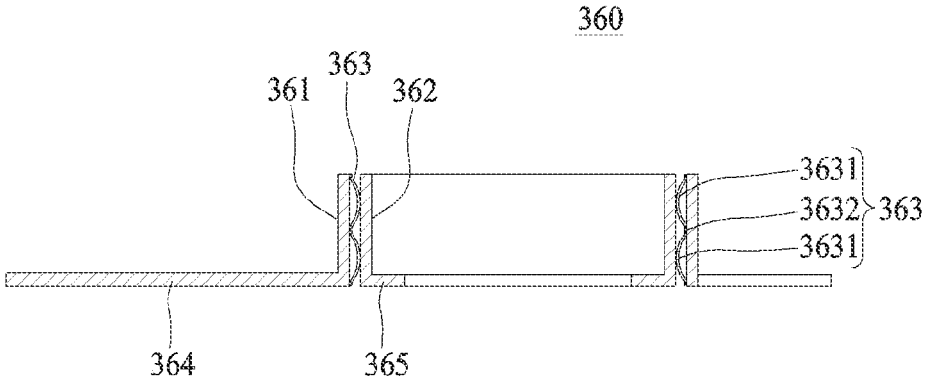
FIG. 19 is a conceptual view illustrating another embodiment of a heat dissipation fin in accordance with the present disclosure.

6. Description of Configuration of Heat Dissipation Fin 360 According to Another Embodiment FIG. 19 is a conceptual view illustrating another embodiment of a heat dissipation fin 360 in accordance with the present disclosure.

The embodiment is different from the previous embodiments of FIGS. 2 to 18 in that the heat dissipation fin 360 includes an elastic member 363 disposed between the outer ring part 361 and the inner ring part 362.

The heat dissipation fin 360 is the same as or similar to the previous embodiments of FIGS. 2 to 18 in view of including the outer ring part 361, the inner ring part 362, the protrusion 365, and the plurality of heat dissipation expansion ribs 364, and thus duplicate descriptions will be omitted.

The outer ring part 361 surrounds and supports the elastic member 363. The inner ring part 362 encloses the bearing 151.

The elastic member 363 is disposed between the outer ring part 361 and the inner ring part 362, and replaces the connection part 163, 263, 263*a*, and 263*b* according to the embodiments of FIGS. 2 to 18, so as to perform the self-aligning function of the heat dissipation fin 360.

One axial end or another axial end of the elastic member 363 may be coupled to one axial end or another axial end of the outer ring part 361. The elastic member 363 may be formed in a cylindrical shape. The elastic member 363 includes a linear portion 3632 and a curved portion 3631. The linear portion 3632 and the curved portion 3631 may be alternately disposed along the axial direction of the elastic member 363.

The linear portion 3632 may extend in the circumferential direction. The linear portion 3632 may be formed in a circular ring shape. The linear portion 3632 may be disposed to be in surface-contact with the inner circumferential surface of the outer ring part 361. The linear portion 3632 may be coupled to the outer ring part 361.

The curved portion 3631 may extend in the circumferential direction. The curved portion 3631 may be formed in a circular ring shape. The curved portion 3631 may be convexly formed from the outer ring part 361 toward the inner ring part 362. The curved portion 3631 may be formed in an arcuate shape with a preset curvature.

The curved portion 3631 may be disposed to be in surface-contact with the outer circumferential surface of the inner ring part 362.

Each of the linear portion 3632 and the curved portion 3631 may be provided in one or plurality. This embodiment illustrates that each of the linear portion 3632 and curved portion 3631 are provided in plurality.

The linear portion 3632 and the curved portion 3631 are integrally formed with each other. The linear portion 3632 may extend in the axial direction to connect the plurality of curved portions 3631 adjacent to each other in the axial direction of the heat dissipation fin 360.

The elastic member 363 may be formed of a metal material having a high heat transfer coefficient.

According to this configuration, the elastic member 363 is disposed between the outer ring part 361 and the inner ring part 362. When axial alignment and concentricity between the plurality of bearings 151 are not secured, the elastic member 363 is elastically deformed according to the inclination of the rotational shaft 150. The inner ring part 362 may be elastically supported by the elastic member 363 and thus can be radially moved or elastically deformed to be in parallel to the inclination of the rotational shaft 150.

Therefore, the inner ring part 362 of the heat dissipation fin 360 can be elastically deformed in a direction parallel to the rotational shaft 150 while enclosing the bearings 151 even when the axial concentricity between the bearings 151 is not offered. This can improve the axial alignment and concentricity between the bearings 151.

The heat dissipation fin 360 according to this embodiment may be applied to enclose one or both of the bearings 151, namely, the first bearing 151*a* and the second bearing 151*b*.

Since other components are the same as or similar to those in the previous embodiments of FIGS. 2 to 18, duplicated descriptions will be omitted.

Figure 20:
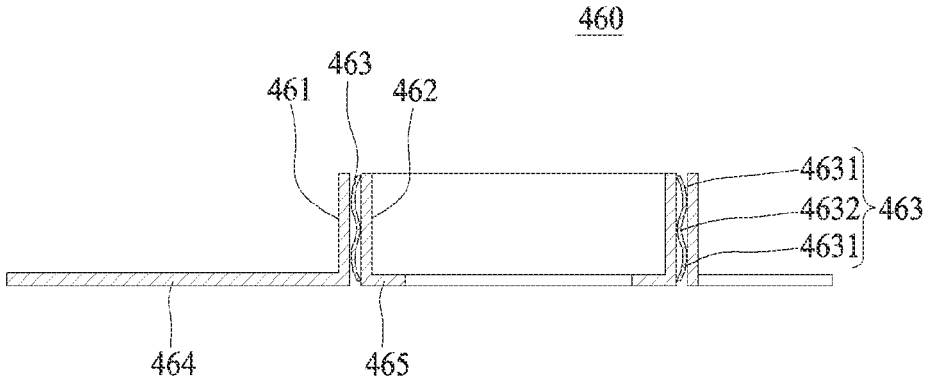
FIG. 20 is a conceptual view illustrating still another embodiment of a heat dissipation fin in accordance with the present disclosure.

7. Description of Configuration of Heat Dissipation Fin 460 According to Still Another Embodiment FIG. 20 is a conceptual view illustrating still another embodiment of a heat dissipation fin 460 in accordance with the present disclosure.

The embodiment is different from the previous embodiments of FIGS. 2 to 18 in that the heat dissipation fin 460 includes an elastic member 463 disposed between the outer ring part 461 and the inner ring part 462.

The heat dissipation fin 460 is the same as or similar to the previous embodiments of FIGS. 2 to 18 in view of including the outer ring part 461, the inner ring part 462, the protrusion 465, and the plurality of heat dissipation expansion ribs 464, and thus duplicate descriptions will be omitted.

The outer ring part 461 surrounds and supports the elastic member 463. The inner ring part 462 encloses the bearing 151.

The elastic member 463 is disposed between the outer ring part 461 and the inner ring part 462, and replaces the connection part 163, 263, 263*a*, and 263*b* according to the embodiments of FIGS. 2 to 18, so as to perform the self-aligning function of the heat dissipation fin 460.

One axial end or another axial end of the elastic member 463 may be coupled to one axial end or another axial end of the outer ring part 461. The elastic member 463 may be formed in a cylindrical shape. The elastic member 463 includes a first curved portion 4631 and a second curved portion 4632. The first curved portion 4631 and the second curved portion 4632 may be alternately disposed along the axial direction of the elastic member 463.

The first curved portion 4631 may extend in the circumferential direction. The first curved portion 4631 may be formed in a circular ring shape. The first curved portion 4631 may be convexly formed from the inner ring part 462 toward the outer ring part 461.

The first curved portion 4631 may be formed in an arcuate shape with a preset curvature. The first curved portion 4631 may be disposed to be in contact with the inner circumferential surface of the outer ring part 461.

The second curved portion 4632 may extend in the circumferential direction. The second curved portion 4632 may be formed in a circular ring shape. The second curved portion 4632 may be convexly formed from the outer ring part 461 toward the inner ring part 462.

The second curved portion 4632 may be formed in an arcuate shape with a preset curvature. The second curved portion 4632 may be disposed to be in contact with the outer circumferential surface of the inner ring part 462.

Each of the first curved portion 4631 and the second curved portion 4632 may be provided in one or plurality. This embodiment illustrates an example in which two first curved portions 4631 and one first curved portion 4631 are provided.

The first curved portion 4631 and the second curved portion 4632 are integrally formed with each other. The second curved portion 4632 extends to connect the plurality of first curved portions 4631 adjacent to each other in the axial direction of the heat dissipation fin 460.

The elastic member 463 may be formed of a metal material having a high heat transfer coefficient.

According to this configuration, the elastic member 463 is disposed between the outer ring part 461 and the inner ring part 462. When axial alignment and concentricity between the plurality of bearings 151 are not secured, the elastic member 363 is elastically deformed according to the inclination of the rotational shaft 150. The inner ring part 462 may be elastically supported by the elastic member 463 and thus can be radially moved or elastically deformed to be in parallel to the inclination of the rotational shaft 150.

Therefore, the inner ring part 462 of the heat dissipation fin 460 can be elastically deformed in a direction parallel to the rotational shaft 150 while enclosing the bearings 151 even when the axial concentricity between the bearings 151 is not obtained. This can improve the axial alignment and concentricity between the bearings 151.

The heat dissipation fin 460 according to this embodiment may be applied to enclose one or both of the bearings 151, namely, the first bearing 151*a* and the second bearing 151*b*.

Since other components are the same as or similar to those in the previous embodiments of FIGS. 2 to 18, duplicated descriptions will be omitted.

What is claimed is:

1. A fan motor comprising:

a rotational shaft that mounts an impeller;

a plurality of bearings supporting the rotational shaft;

a heat dissipation fin surrounding at least one of the plurality of bearings; and a bearing housing, wherein the heat dissipation fin comprises:

an outer ring having a cylindrical shape, an inner ring surrounding the bearing and disposed inside the outer ring, the inner ring being radially spaced apart from an inner circumferential surface of the outer ring, a connector extending between the outer ring and the inner ring and connecting the outer ring to the inner ring, and a plurality of heat dissipation expansion ribs each protruding radially outward from an outer circumferential surface of the outer ring and coupled to the bearing housing, and wherein the bearing housing surrounds the outer ring.

2. The fan motor of claim 1, wherein the inner ring extends in a cylindrical shape along an axial direction, and wherein the inner ring has a free end that is movable radially relative to a side of the inner ring supported by the connector, the free end being configured to be elastically deformed and inclined in a direction parallel to the rotational shaft that is inclined based on the plurality of bearings being axially misaligned with each other.

3. The fan motor of claim 1, wherein the heat dissipation fin further comprises a protrusion protruding radially inward from an end of the inner ring.

4. The fan motor of claim 1, further comprising:

a rotor having a permanent magnet and mounted at the rotational shaft; and a plurality of bearing housings accommodating the plurality of bearings, respectively, wherein the plurality of bearings are mounted at both sides of the rotational shaft with the rotor interposed therebetween, the plurality of bearings including a first bearing disposed adjacent to the impeller and a second bearing disposed at an opposite side to the first bearing, and wherein the heat dissipation fin is disposed between the second bearing and a second bearing housing accommodating the second bearing.

5. The fan motor of claim 1, further comprising:

a rotor having a permanent magnet and mounted at the rotational shaft;

a stator having a coil and surrounding the rotor; and a plurality of bearing housings accommodating the plurality of bearings, respectively, wherein the heat dissipation fin is disposed between (i) a second bearing disposed at a downstream side of the coil based on a flow direction of air suctioned by the impeller and (ii) a second bearing housing accommodating the second bearing, and wherein the fan motor further comprises an insulation cover disposed between the coil and the heat dissipation fin and covering the heat dissipation fin.

6. The fan motor of claim 1, further comprising a bearing housing surrounding and supporting the outer ring, and wherein the heat dissipation fin includes a material different from a material of the bearing housing and is integrally coupled to an inner surface of the bearing housing.

7. The fan motor of claim 6, wherein the bearing housing includes a plastic material, and wherein the heat dissipation fin includes a metal material.

8. The fan motor of claim 1, further comprising:

a shroud accommodating the impeller;

a plurality of vanes coupled to an inside of the shroud and configured to guide a flow of air suctioned by the impeller;

a vane hub having the plurality of vanes at an outer circumferential surface of the vane hub; and a plurality of bearing housings accommodating the plurality of bearings, respectively, wherein a first bearing of the plurality of bearings is disposed at a downstream side of the impeller based on a flow direction of the air, wherein a first bearing housing of the plurality of bearing housings accommodates the heat dissipation fin surrounding the first bearing, and wherein the first bearing housing is accommodated inside the vane hub.

9. The fan motor of claim 8, wherein a first recess is defined at a side surface of the vane hub in an axial direction, wherein a vane cover is accommodated at the first recess, wherein a second recess is defined at a side surface of the vane cover in the axial direction, and wherein a portion of the impeller is accommodated at the second recess.

10. The fan motor of claim 1, wherein the inner ring has a cylindrical shape, wherein the outer ring and the inner ring are disposed concentrically around the rotational shaft, and wherein the connector extends radially between an inner circumferential surface of the outer ring and an outer circumferential surface of the inner ring.

11. The fan motor of claim 10, wherein the connector connects a longitudinal center of the outer ring to a longitudinal center of the inner ring.

12. The fan motor of claim 10, wherein the connector connects an end of the outer ring to an end of the inner ring.

13. The fan motor of claim 1, further comprising:

a rotor having a permanent magnet and mounted at the rotational shaft; and a plurality of bearing housings accommodating the plurality of bearings, respectively, wherein the plurality of bearings are mounted at both sides of the rotational shaft with the rotor interposed therebetween, the plurality of bearings including a first bearing disposed adjacent to the impeller and a second bearing disposed at an opposite side to the first bearing, wherein the heat dissipation fin comprises:

a first heat dissipation fin disposed between the first bearing and a first bearing housing accommodating the first bearing, and a second heat dissipation fin disposed between the second bearing and a second bearing housing accommodating the second bearing.

14. The fan motor of claim 13, further comprising a stopper that faces the impeller and extends radially inward from an end of the first bearing housing to thereby cover the first bearing.

15. The fan motor of claim 13, further comprising:

a shroud accommodating the impeller;

a first housing accommodating the first bearing housing; and a second housing disposed at a downstream side of the first housing based on a flow direction of air suctioned by the impeller, the second housing accommodating the second bearing housing, wherein the first housing comprises:

a first coupling ring coupled to an inside of the shroud, and a plurality of first bridges extending radially between the first coupling ring and the first bearing housing.

16. The fan motor of claim 13, further comprising:

a shroud accommodating the impeller;

a first housing coupled to an inside of the shroud; and a second housing coupled to a downstream side of the first housing based on a flow direction of air suctioned by the impeller, and wherein the second housing comprises:

a second coupling ring coupled to the inside of the shroud, an accommodating portion extending axially from the second coupling ring, and a plurality of second bridges extending radially between the accommodating portion and the second bearing housing.

17. A fan motor comprising:

a rotational shaft that mounts an impeller;

a plurality of bearings supporting the rotational shaft;

a bearing housing; and a heat dissipation fin surrounding at least one of the plurality of bearings, wherein the heat dissipation fin comprises:

an outer ring, an inner ring disposed inside the outer ring and surrounding the bearing, an elastic member disposed between the outer ring and the inner ring and elastically supporting the inner ring, and a plurality of heat dissipation expansion ribs each protruding radially outward from an outer circumferential surface of the outer ring and coupled to the bearing housing, wherein the bearing housing surrounds the outer ring, and wherein the inner ring is configured to be elastically deformed in parallel with an inclination of the rotational shaft based on the plurality of bearings being misaligned with each other in an axial direction.

18. The fan motor of claim 17, wherein the elastic member has a cylindrical shape, wherein a cross-sectional shape that is cut along a longitudinal direction of the elastic member includes:

a plurality of curved portions defined in an arcuate shape and configured to contact the outer ring or the inner ring in a circumferential direction, and a linear portion extending in the axial direction and connecting the plurality of curved portions adjacent to each other in the axial direction.

19. The fan motor of claim 17, wherein the elastic member has a cylindrical shape, wherein a cross-sectional shape that is cut along a longitudinal direction of the elastic member includes:

a first curved portion configured to contact the outer ring or the inner ring in a circumferential direction, and a second curved portion connected to the first curved portion and being curved in an opposite direction to the first curved portion.

* * * * *